US010405646B2

(12) United States Patent
Tseng et al.

(10) Patent No.: US 10,405,646 B2
(45) Date of Patent: Sep. 10, 2019

(54) LIFTABLE TABLE FOOT FRAME THAT IS EASILY ASSEMBLED

(71) Applicant: TIMOTION TECHNOLOGY CO., LTD., New Taipei (TW)

(72) Inventors: Kuan-Shu Tseng, New Taipei (TW); Chou-Hsin Wu, New Taipei (TW); Tsung-Ling Lee, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/056,091

(22) Filed: Aug. 6, 2018

(65) Prior Publication Data

US 2019/0125072 A1 May 2, 2019

Related U.S. Application Data

(60) Provisional application No. 62/577,328, filed on Oct. 26, 2017.

(51) Int. Cl.
*A47B 13/02* (2006.01)
*A47B 9/20* (2006.01)
(Continued)

(52) U.S. Cl.
CPC ..... *A47B 13/021* (2013.01); *A47B 3/0818* (2013.01); *A47B 9/20* (2013.01);
(Continued)

(58) Field of Classification Search
CPC ..... A47B 3/091; A47B 3/08; A47B 3/0809; A47B 3/0818; A47B 3/002; A47B 2003/025
(Continued)

(56) References Cited

U.S. PATENT DOCUMENTS 4,064,815 A * 12/1977 Baum ..... A47B 3/0812 108/129
4,444,124 A * 4/1984 Burr ..... A47B 3/0918 108/131
(Continued)

FOREIGN PATENT DOCUMENTS

EP 1366688 A1 12/2003
EP 2926688 A1 10/2015
(Continued)

OTHER PUBLICATIONS

Office Action dated Nov. 2, 2018 of the corresponding Danish patent application No. PA201870086.
(Continued)

*Primary Examiner* — Jose V Chen
(74) *Attorney, Agent, or Firm* — Chun-Minh Shih; HDLS IPR Services

(57) ABSTRACT

A liftable table foot frame (1) that is easily assembled includes a horizontal frame body (10), a post (20), a side wing (30) and a linking mechanism (40). The horizontal frame body (10) includes a horizontal rod (11). One end of the post (20) pivotally connects to the horizontal rod (11). The side wing (30) includes a plate body (31) and inserting blocks (32) connected to the plate body (31). The inserting blocks (32) separately couple with an end of the horizontal rod (11). The linking mechanism (40) connects the post (20) and the side wing (30). When the post (20) is turned out relative to the horizontal rod (11), the inserting blocks (32) are driven toward the horizontal rod (11) through the linking mechanism (40) to tense and position. Thus, easiness and convenience of assembling can be increased.

12 Claims, 25 Drawing Sheets

(51) Int. Cl.
*A47B 3/08* (2006.01)
*A47B 13/06* (2006.01)

(52) U.S. Cl.
CPC ..... *A47B 13/06* (2013.01); *A47B 2003/0824* (2013.01); *A47B 2200/0051* (2013.01)

(58) Field of Classification Search
USPC ..... 108/129, 131, 132; 248/188.6
See application file for complete search history.

(56) References Cited

U.S. PATENT DOCUMENTS

| | | | | | |
|---|---|---|---|---|---|
| 4,561,622 | A | | 12/1985 | Heinzel | |
| 4,838,180 | A | * | 6/1989 | Gutgsell | A47B 3/0911 108/132 |
| 5,528,997 | A | * | 6/1996 | Miller | A47B 3/0912 108/131 |
| 5,606,922 | A | * | 3/1997 | Adams | A47B 3/0911 108/129 |
| 5,673,633 | A | * | 10/1997 | Pfister | A47B 3/0815 108/131 |
| 5,913,272 | A | * | 6/1999 | Gutgsell | A47B 3/00 108/132 |
| 2003/0116685 | A1 | | 6/2003 | Jensen | |
| 2005/0235886 | A1 | * | 10/2005 | Koning | A47B 3/0818 108/132 |
| 2008/0178778 | A1 | * | 7/2008 | Koning | A47B 3/0818 108/132 |
| 2013/0104782 | A1 | * | 5/2013 | Rogers | A47B 3/0912 108/132 |
| 2015/0282605 | A1 | * | 10/2015 | Wu | A47B 3/002 248/188.2 |
| 2016/0037904 | A1 | | 2/2016 | Wu | |
| 2018/0110324 | A1 | * | 4/2018 | Keller | A47B 3/08 |
| 2018/0242728 | A1 | | 8/2018 | Hansen et al. | |
| 2019/0082823 | A1 | * | 3/2019 | Applegate | A47B 13/003 |

FOREIGN PATENT DOCUMENTS

| | | | |
|---|---|---|---|
| JP | 2000083740 | A | 3/2000 |
| TW | M546736 | U | 8/2017 |
| WO | 2018093323 | A1 | 5/2018 |
| WO | 2018093324 | A1 | 5/2018 |

OTHER PUBLICATIONS

Office Action dated Nov. 9, 2018 of the corresponding Taiwan patent application.
Office Action dated Apr. 18, 2019 of the corresponding Korean patent application.

* cited by examiner

LIFTABLE TABLE FOOT FRAME THAT IS EASILY ASSEMBLED

CROSS-REFERENCE TO RELATED APPLICATION

This patent application claims the benefit of U.S. Provisional Patent Application No. 62/577,328, filed Oct. 26, 2017. The entire disclosures of the above applications are all incorporated herein by reference.

BACKGROUND OF THE INVENTION

1. Technical Field

The invention relates a liftable table, particularly to a liftable table foot frame that is easily assembled.

2. Related Art

To satisfy various body types and height and users' preference, conventional fixed tables have progressively been abandoned by people. Tables with height adjustment have become one of the mainstream and trend. Height adjustment can match users' various body types to achieve the purpose of comfort.

Some of currently available liftable tables use a pneumatic cylinder to serve as a foot. Table height can be adjusted by lift of the pneumatic cylinder. In operation, however, the lifting speed of the pneumatic cylinder is fast and declining needs a user to press down the pneumatic cylinder, so the table height is hard to be adjusted to a desired position because of an improper force exerted by the user. A desired position usually needs several lifting and declining operations. Thus, its effectiveness is not good enough.

Some liftable tables use an electric cylinder to serve as a foot. Although they can overcome the abovementioned problem of inconvenience of height adjustment, a large amount of screws is required to assemble. Its assembling needs not only a complicated process but also a large amount of labor cost or time cost. In addition, assembling errors or deviations are easy to occur for unskilled workers.

SUMMARY OF THE INVENTION

An object of the invention is to provide a liftable table foot frame that is easily assembled, which utilizes a linking mechanism to connect a side wing and a post. When the post is turned out, the side wing is simultaneously driven to position. Thus, easiness and convenience of assembling can be increased.

To accomplish the above object, the invention provides a liftable table foot frame that is easily assembled, which includes a horizontal frame body, a post, a side wing and a linking mechanism. The horizontal frame body includes a horizontal rod. One end of the post pivotally connects to the horizontal rod. The side wing includes a plate body and inserting blocks connected to the plate body. The inserting blocks separately couple with an end of the horizontal rod. The linking mechanism connects the post and the side wing. When the post is turned out relative to the horizontal rods, the inserting blocks are driven toward the horizontal rod through the linking mechanism to tense and position.

The invention also has the following functions. By the property of flexible deformation of the buffer portion, the first connecting member and the second connecting member can be firmly fastened to the sides of the base plate. By the jointly positioning of the side wing and the post, not only can the assembling process be effectively simplified, but also even any unskilled workers can achieve a great assembling effect to save labor cost and time cost.

DETAILED DESCRIPTION OF THE INVENTION

Figure 1:
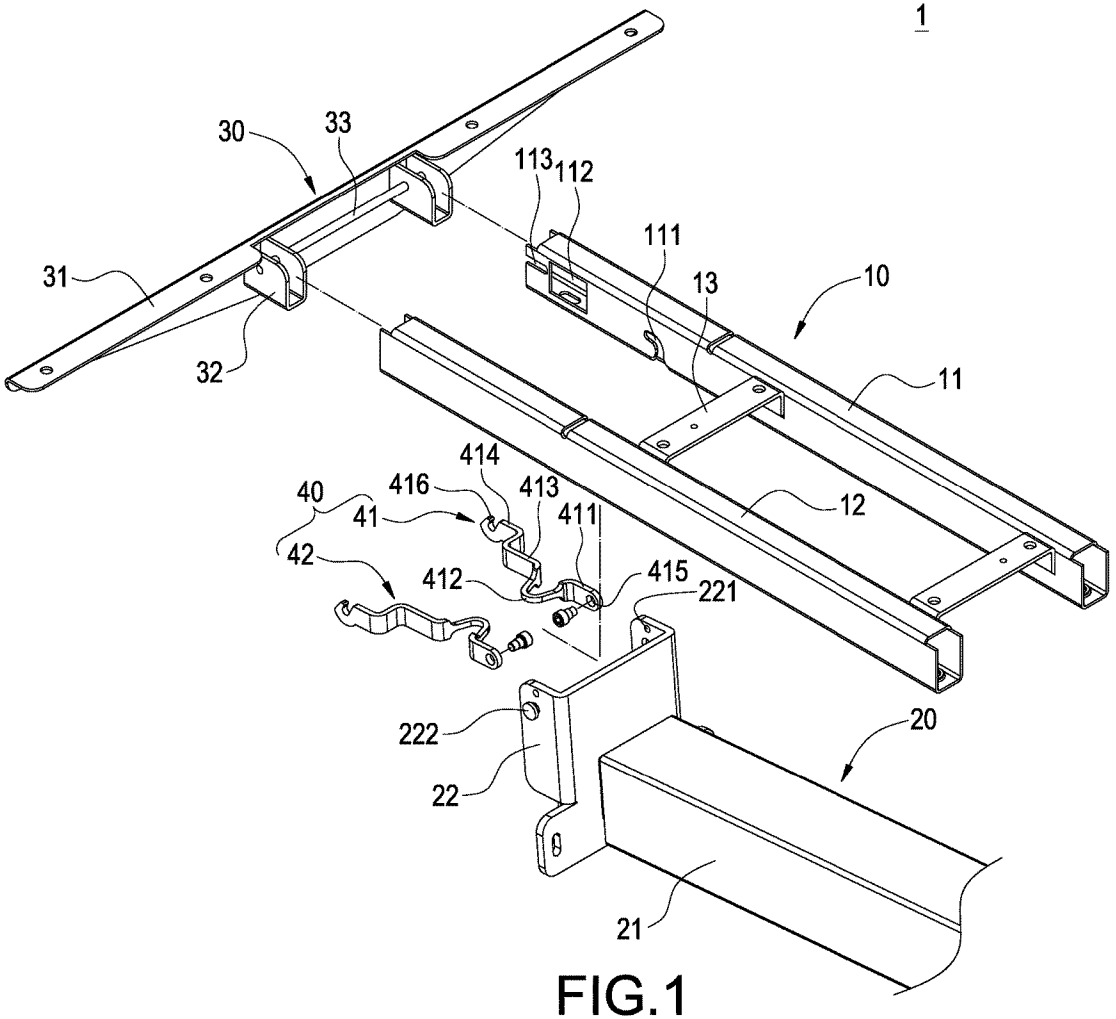
FIGS. 1-10 are exploded views, assembled views and using status views of the first embodiment of the invention.
Figure 2:
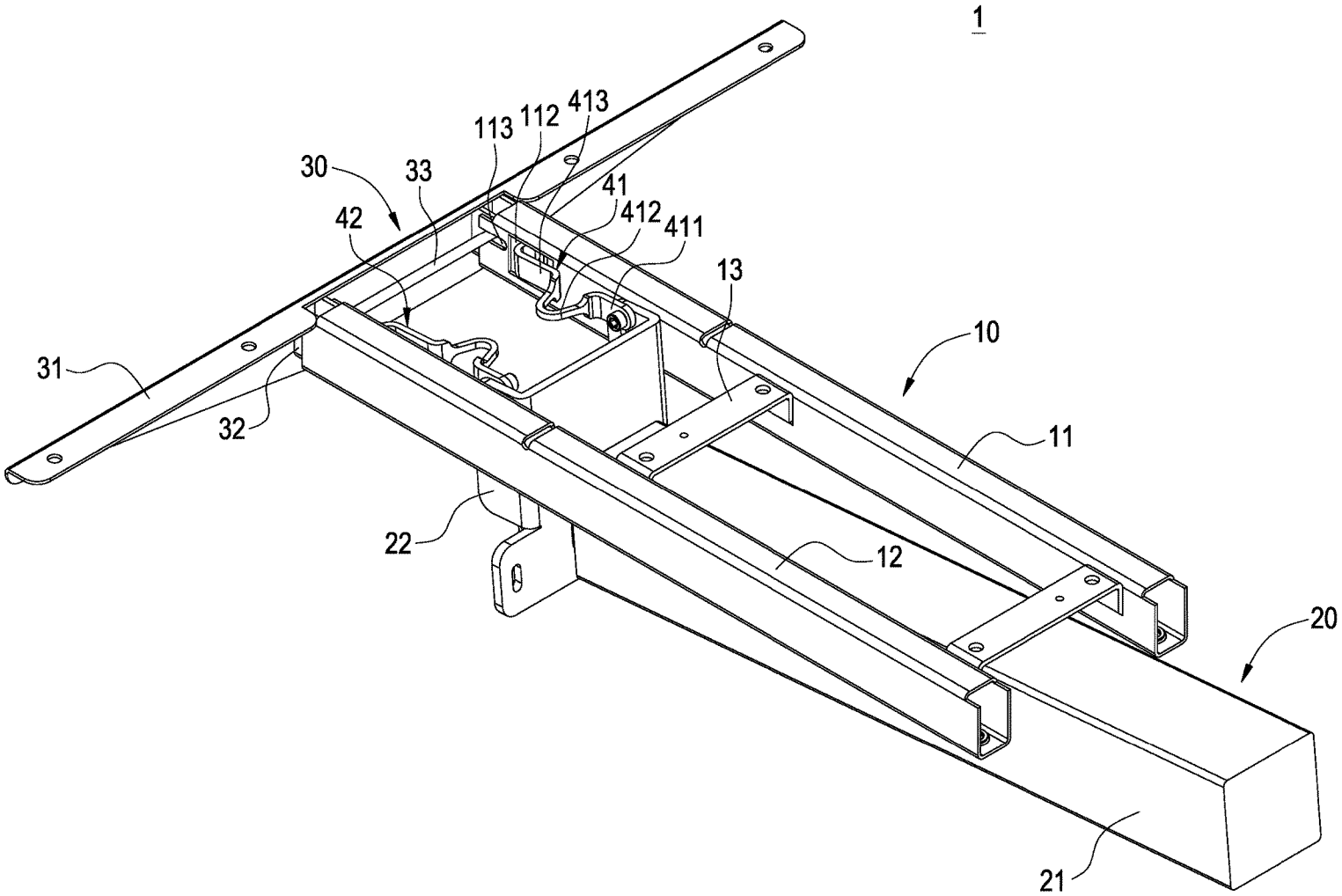
Figure 3:
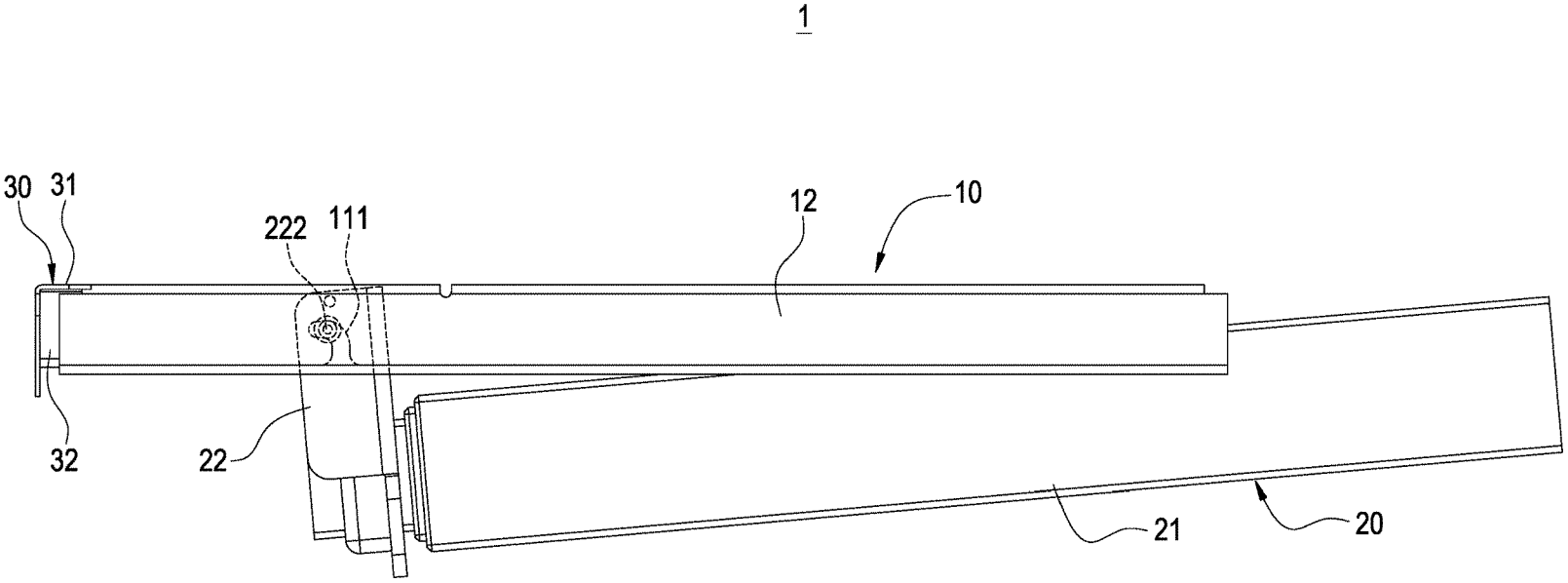
Figure 4:
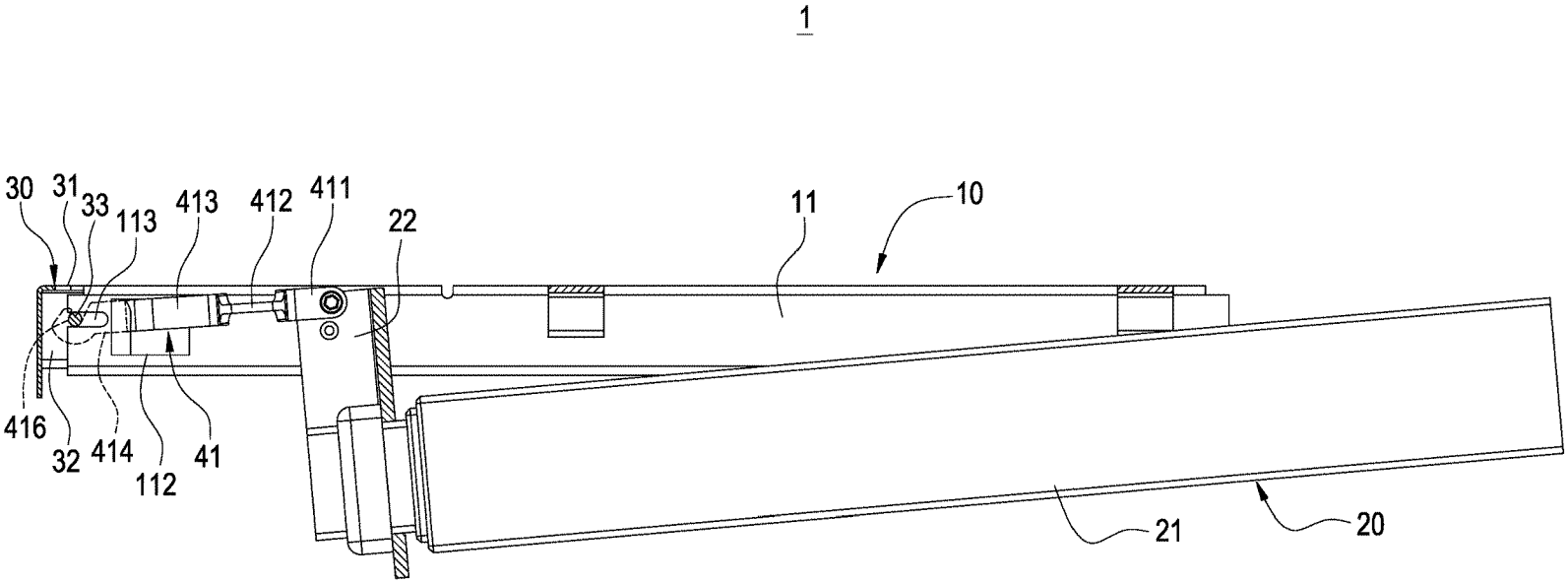
Figure 5:
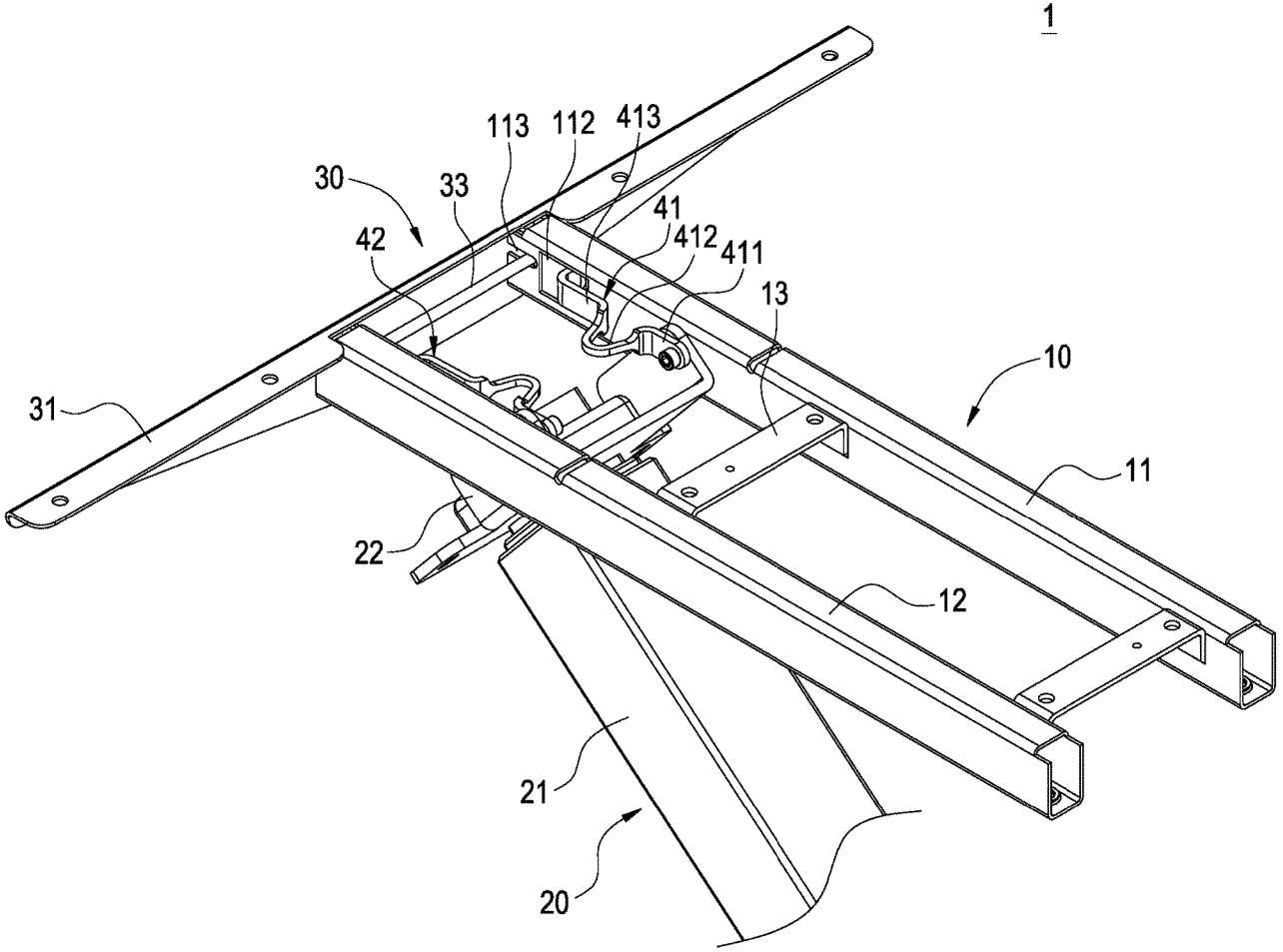
Figure 6:
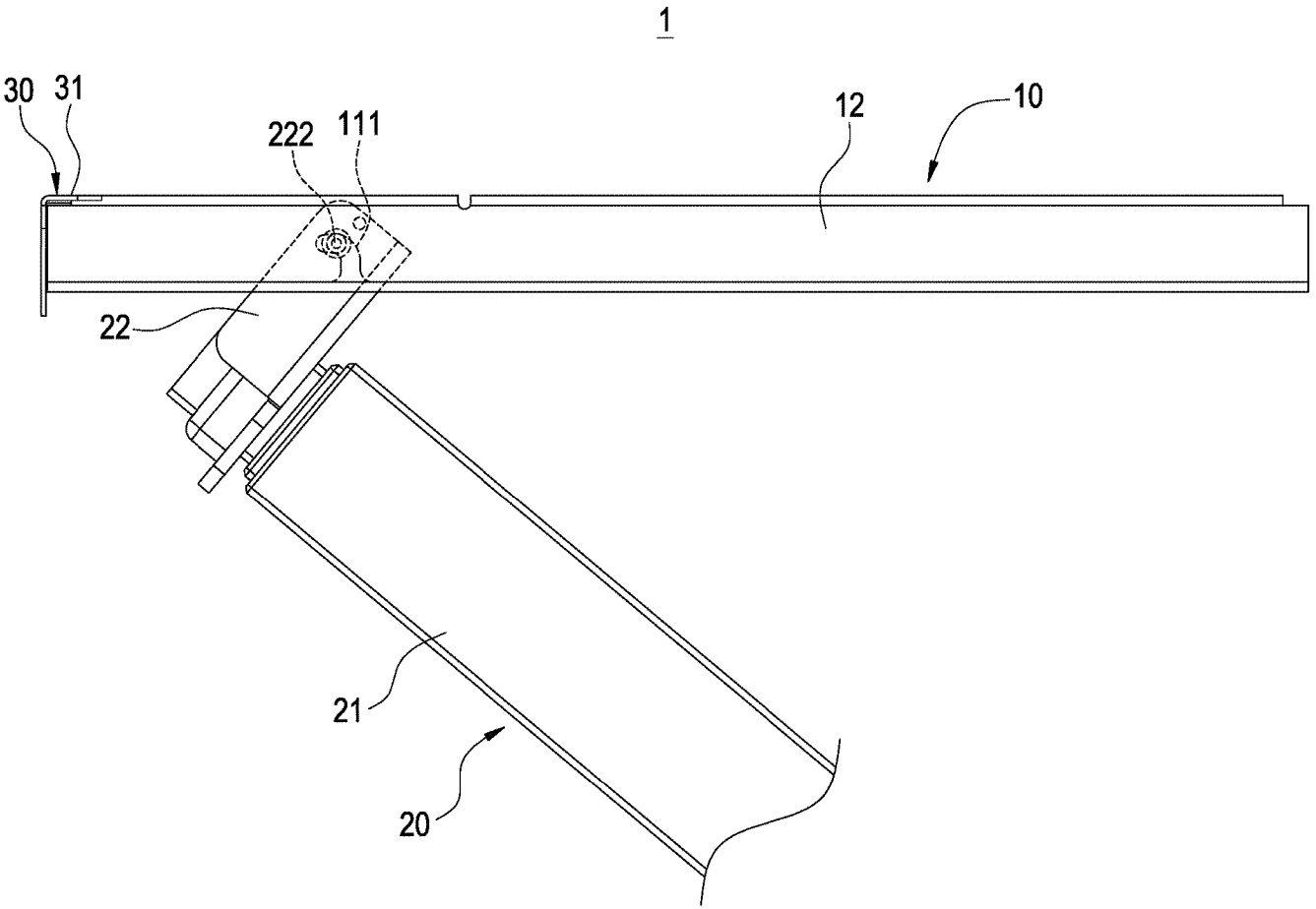
Figure 7:
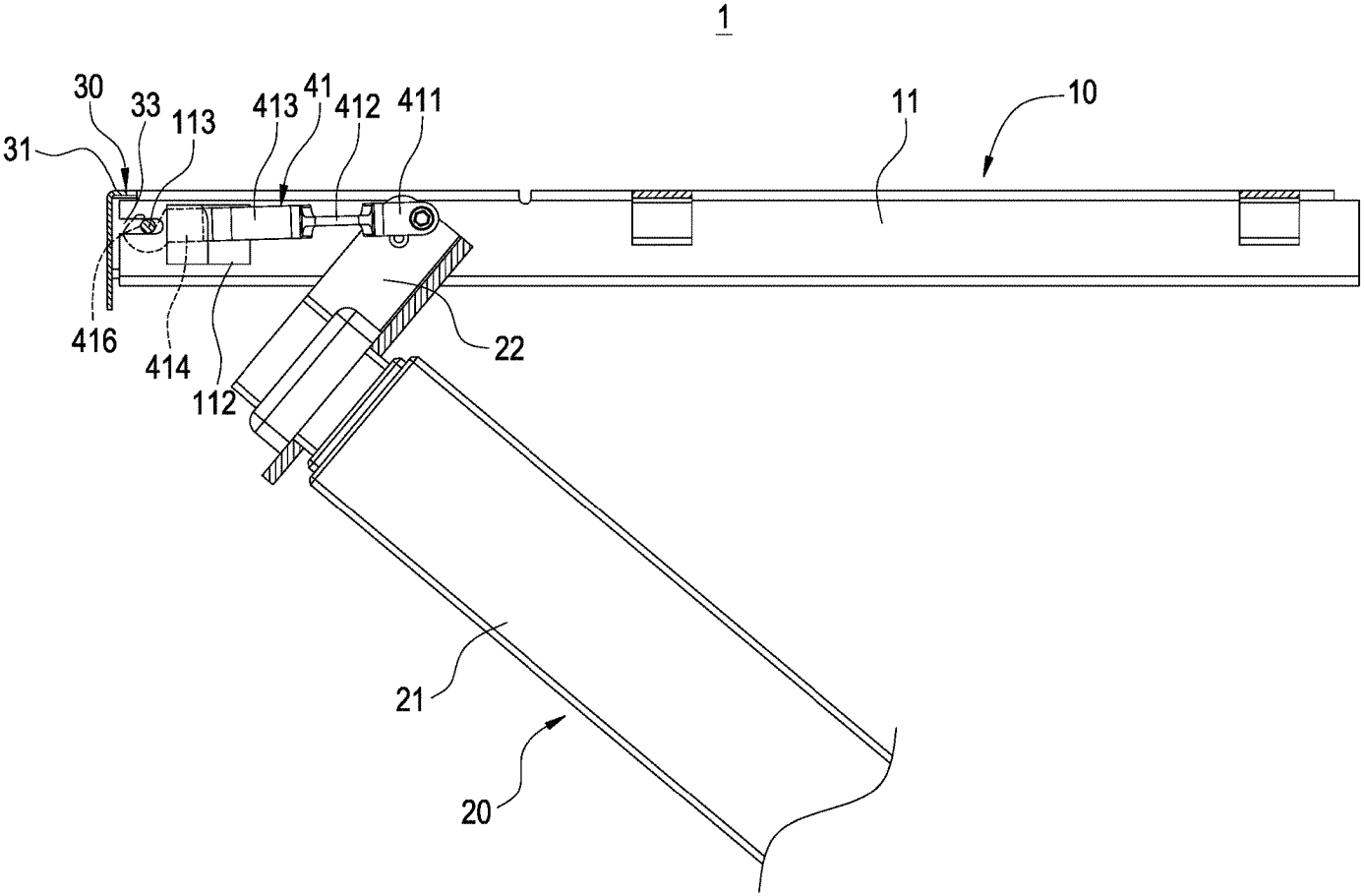
Figure 8:
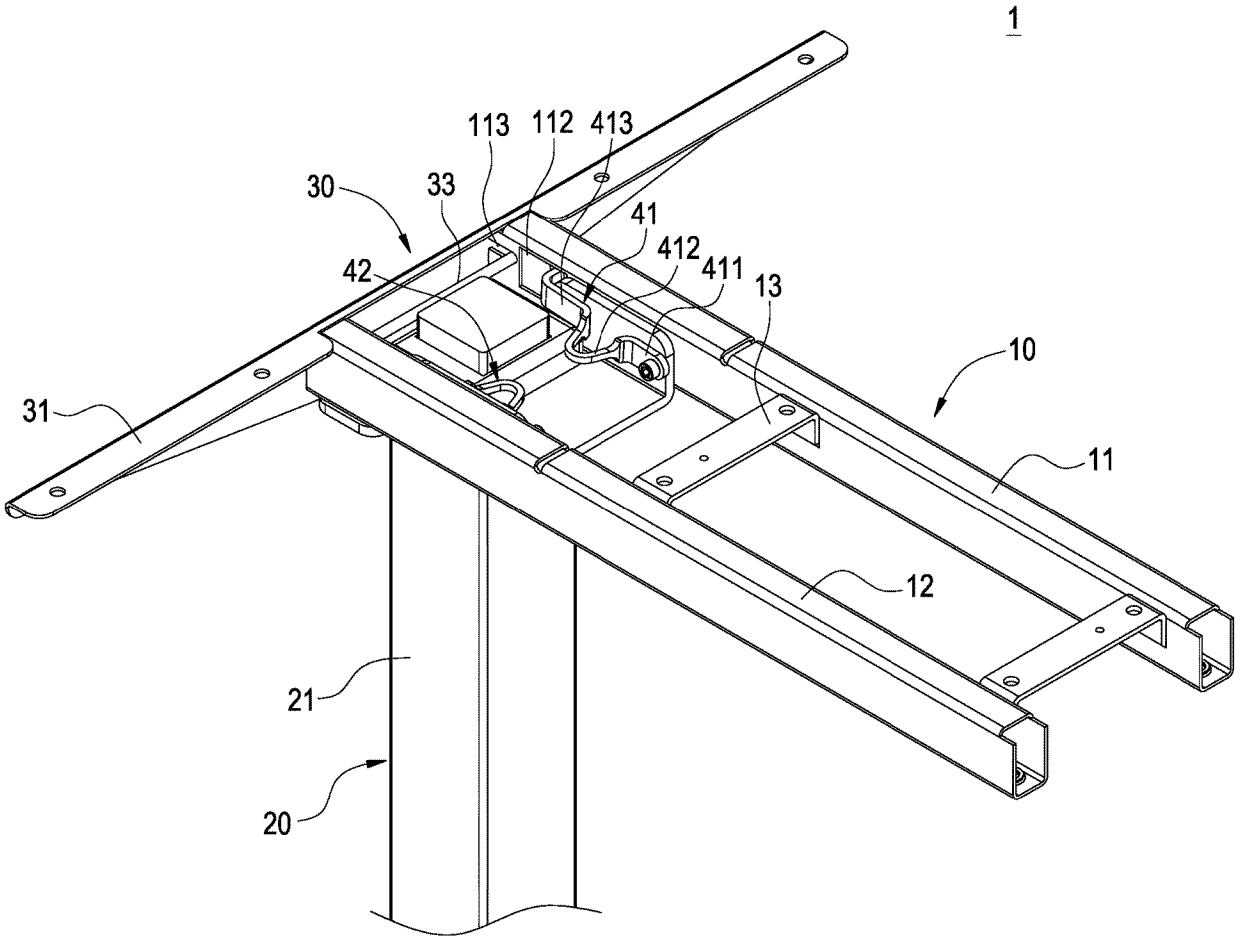
Figure 9:
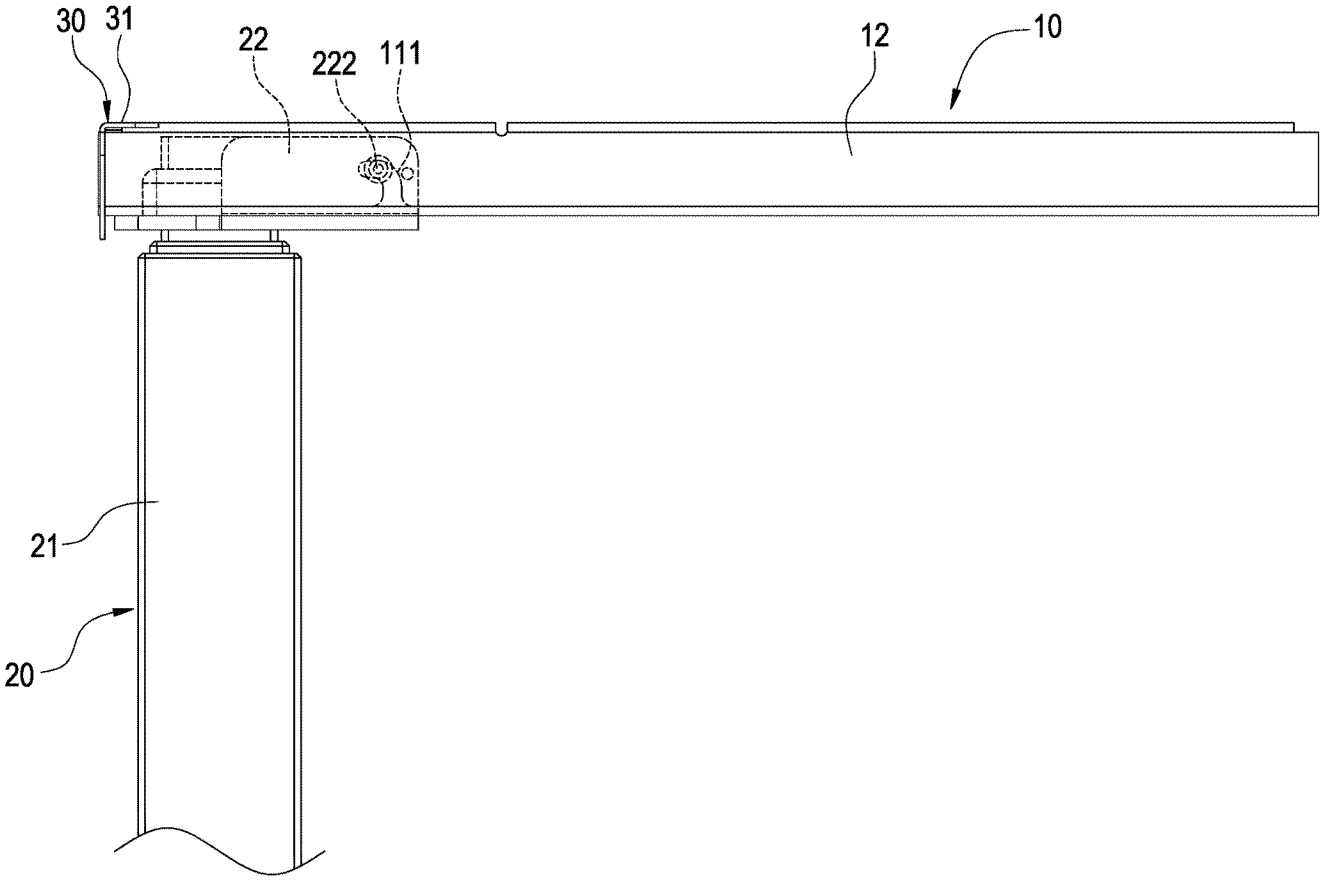
Figure 10:
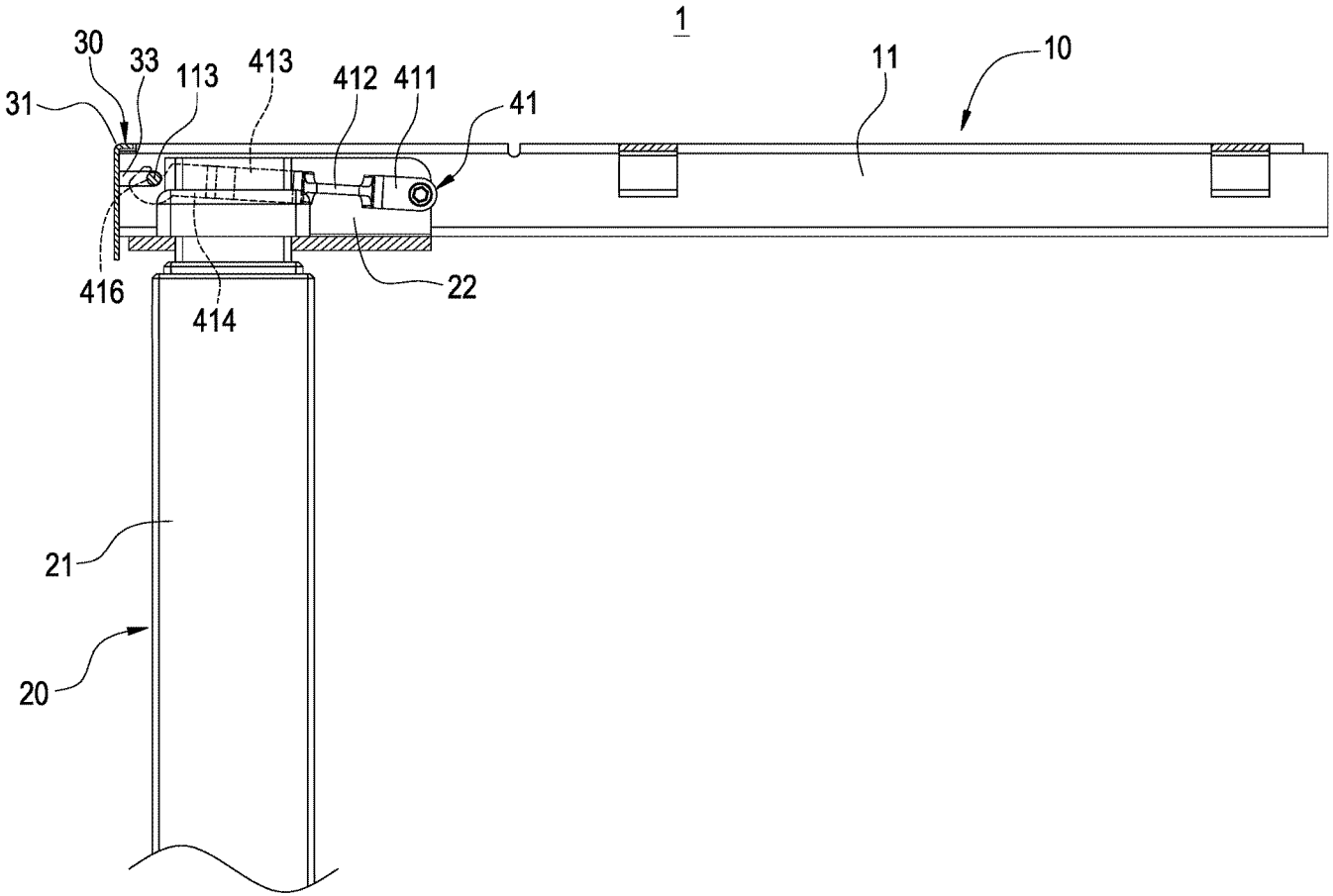
Figure 11:
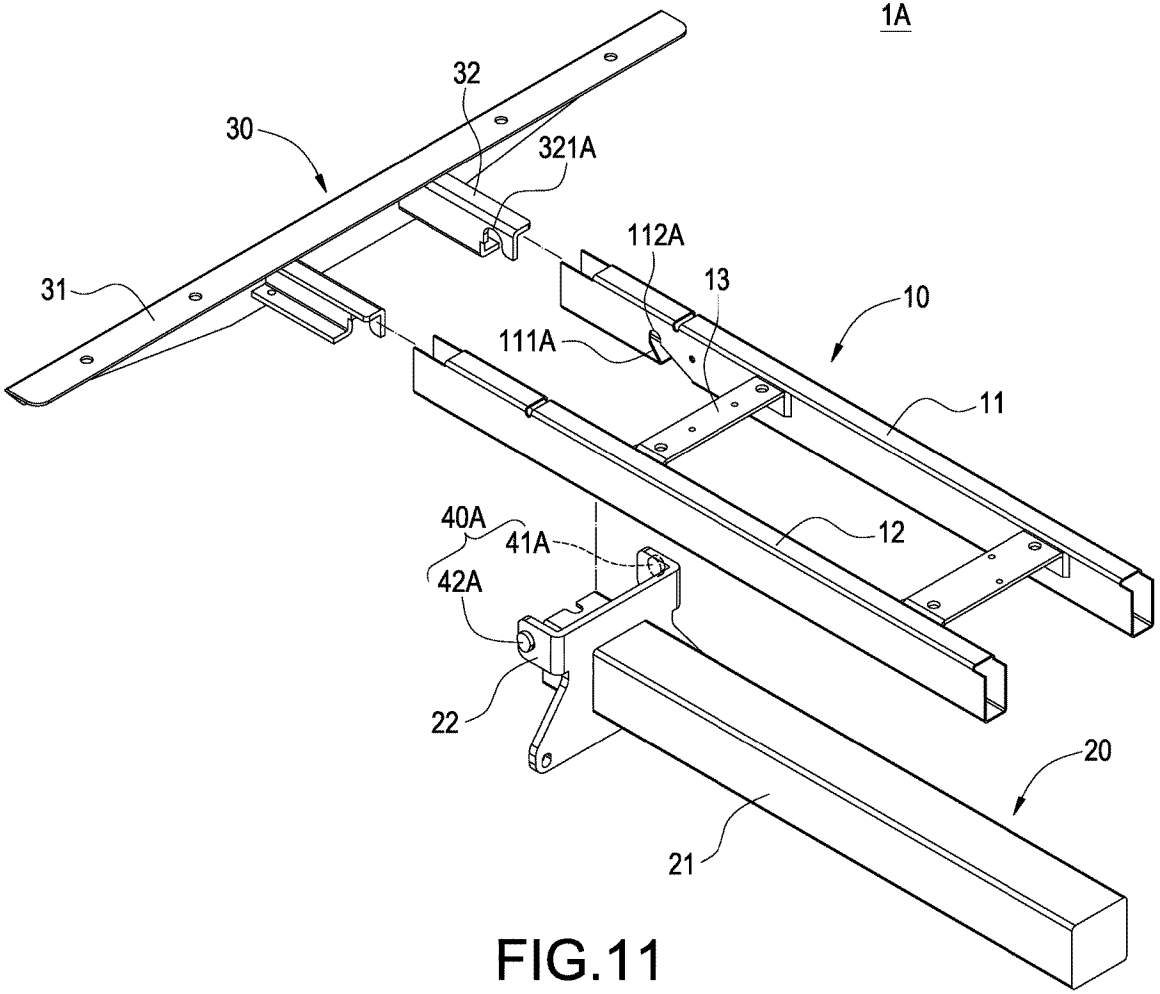
FIGS. 11-17 are exploded views, assembled views and using status views of the second embodiment of the invention.
Figure 12:
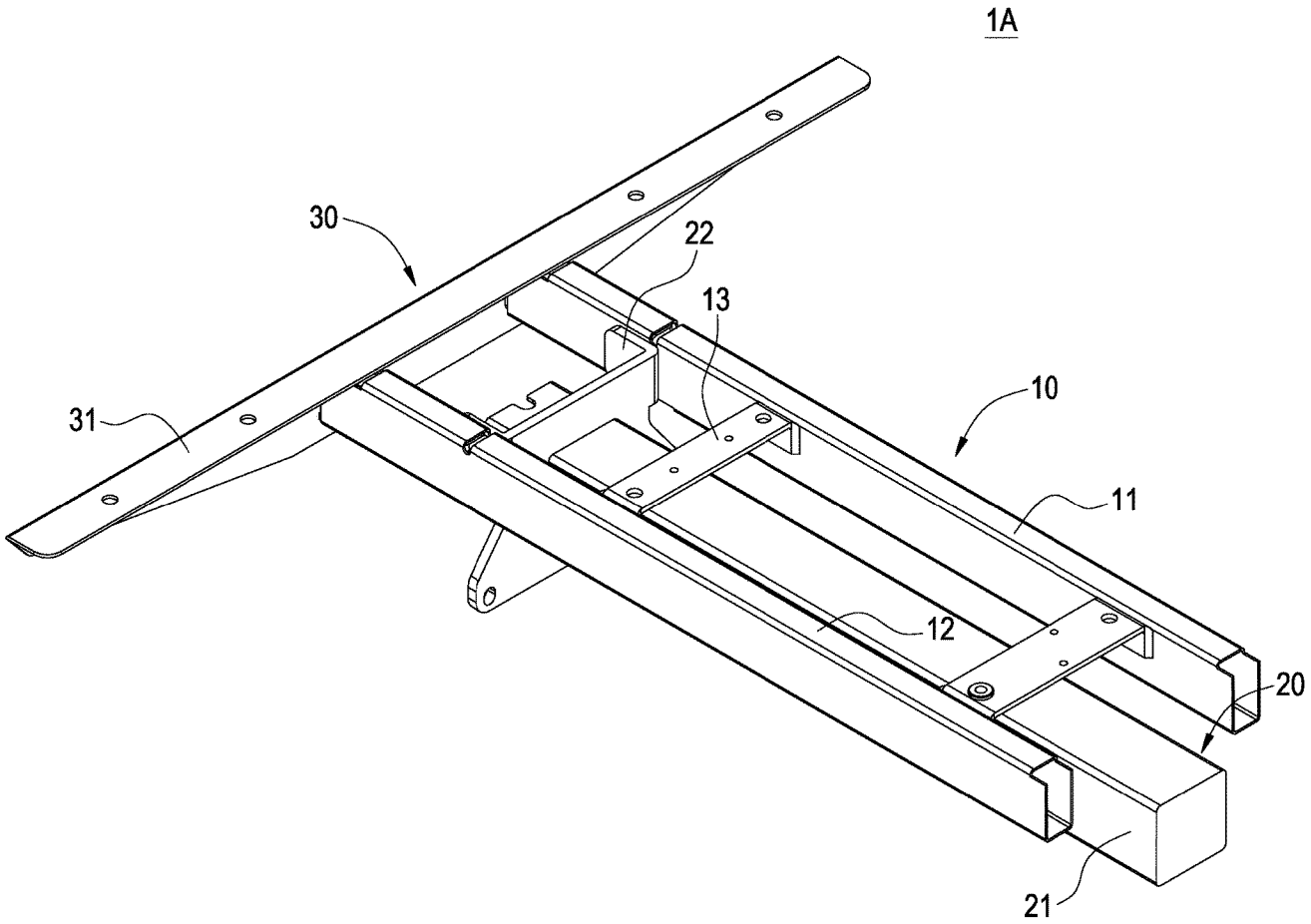
Figure 13:
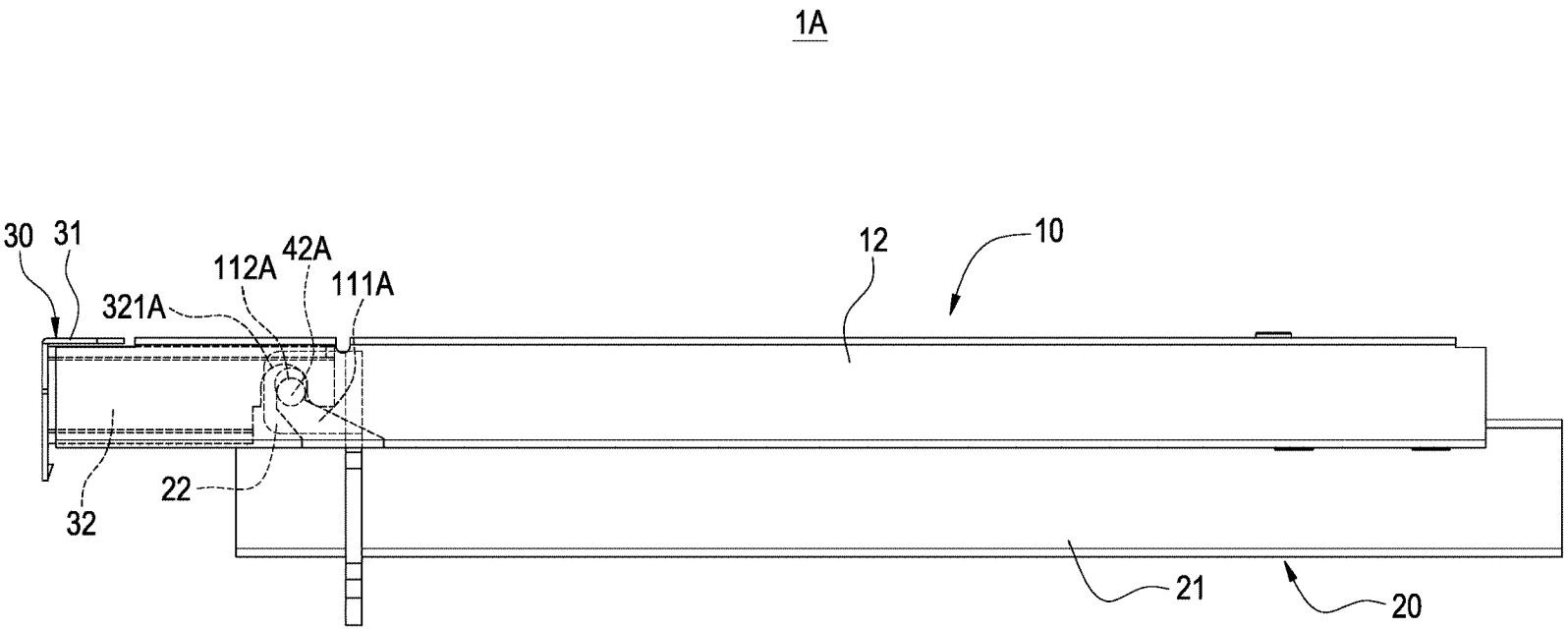
Figure 14:
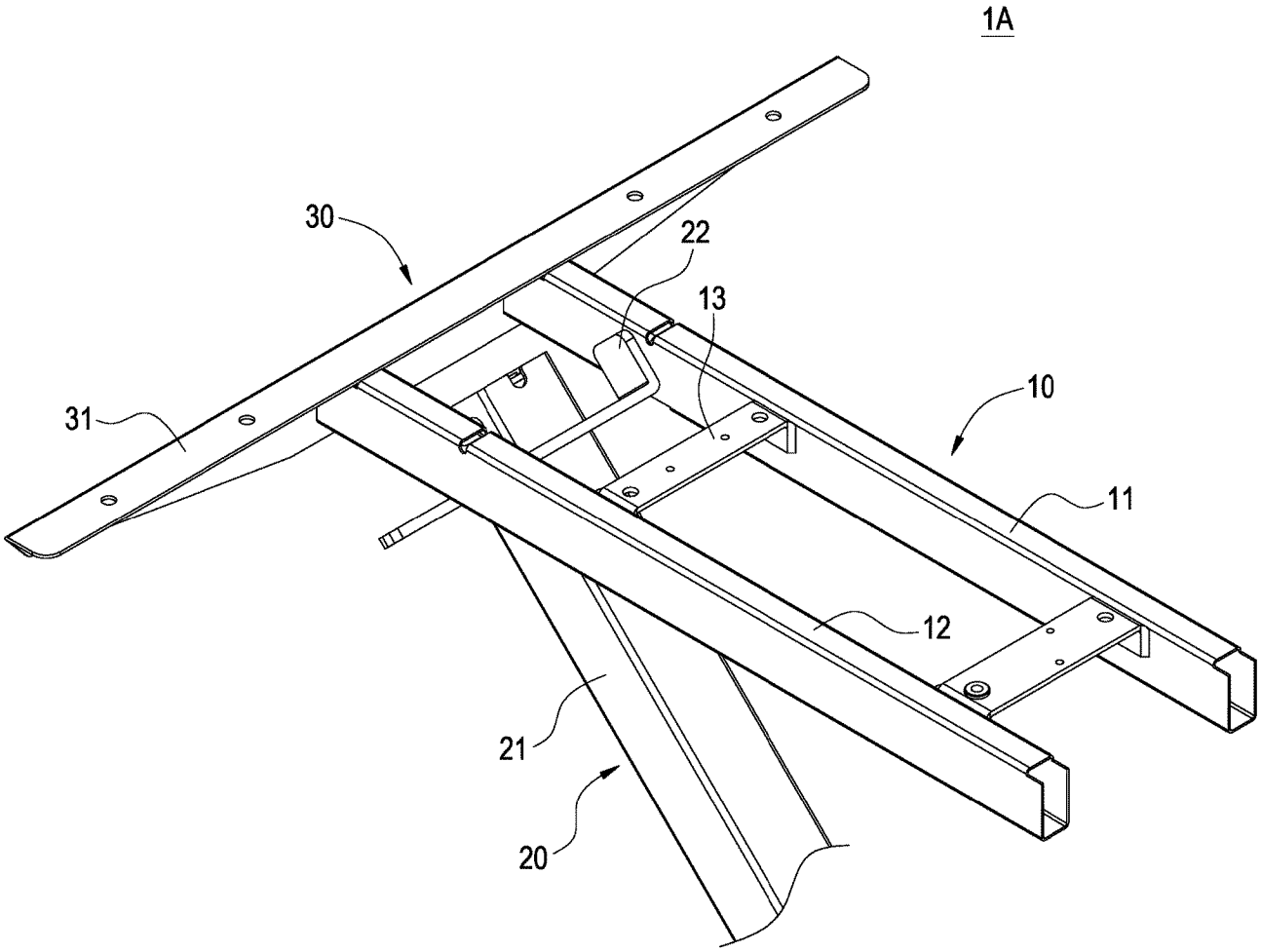
Figure 15:
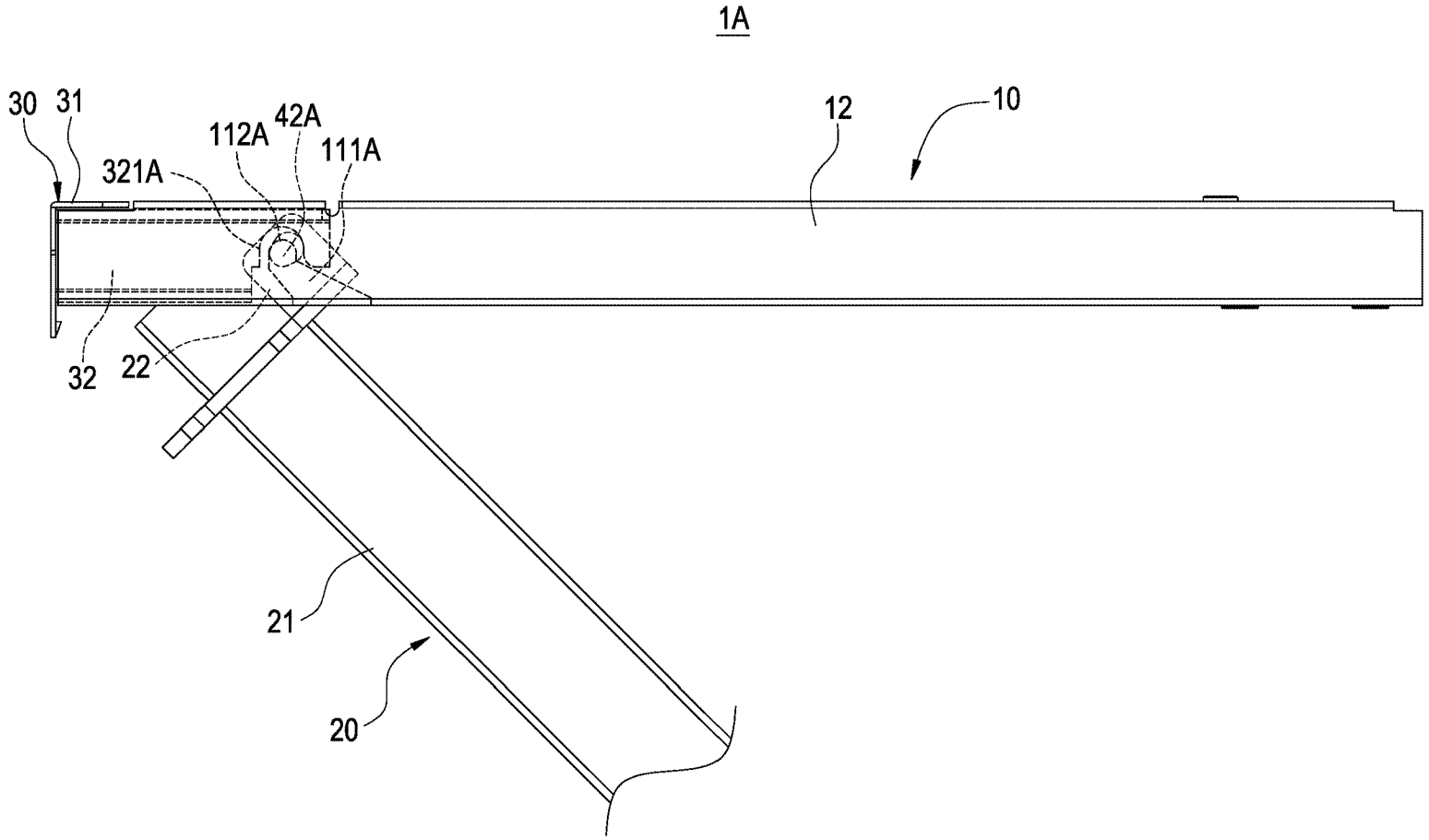
Figure 16:
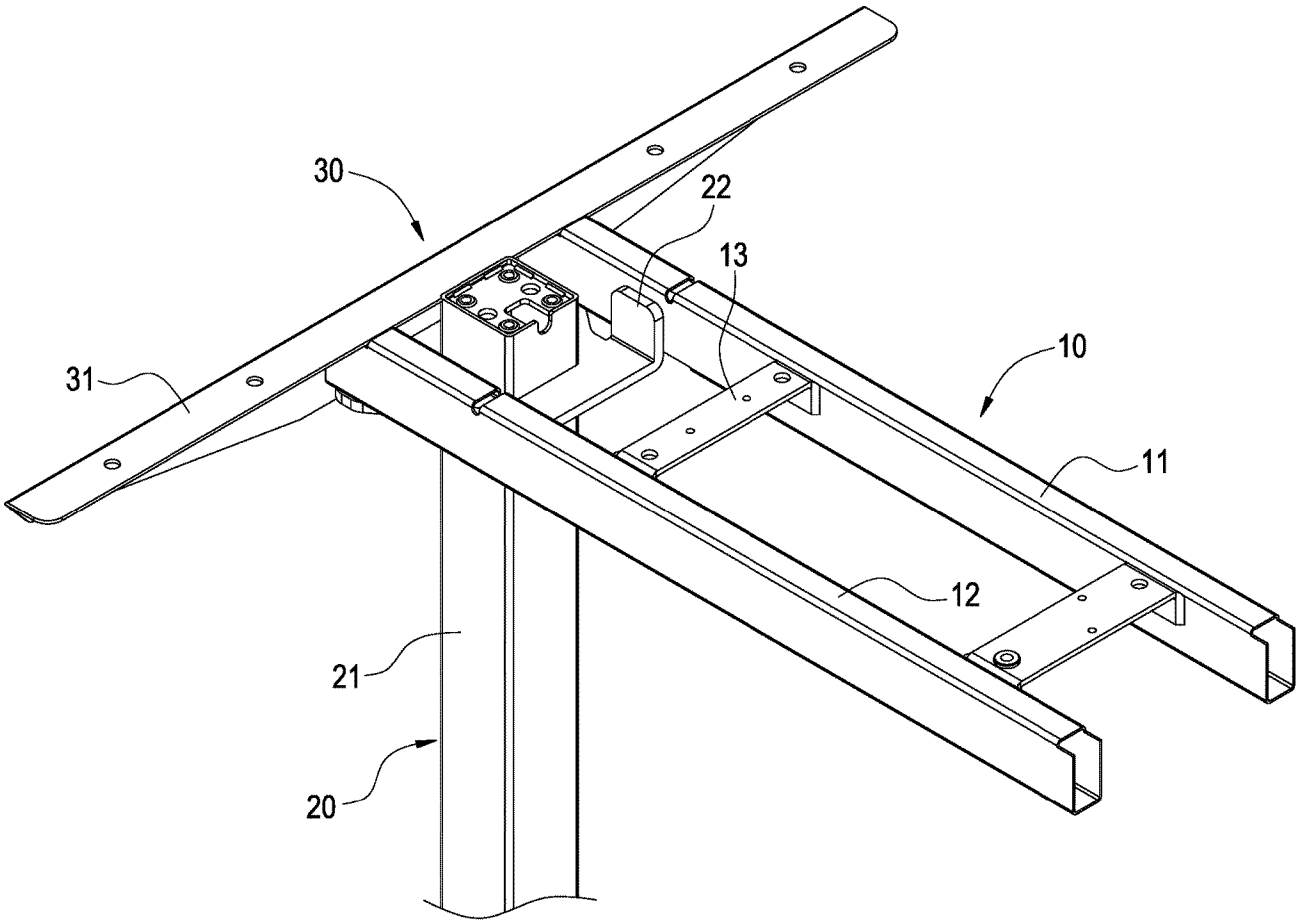
Figure 17:
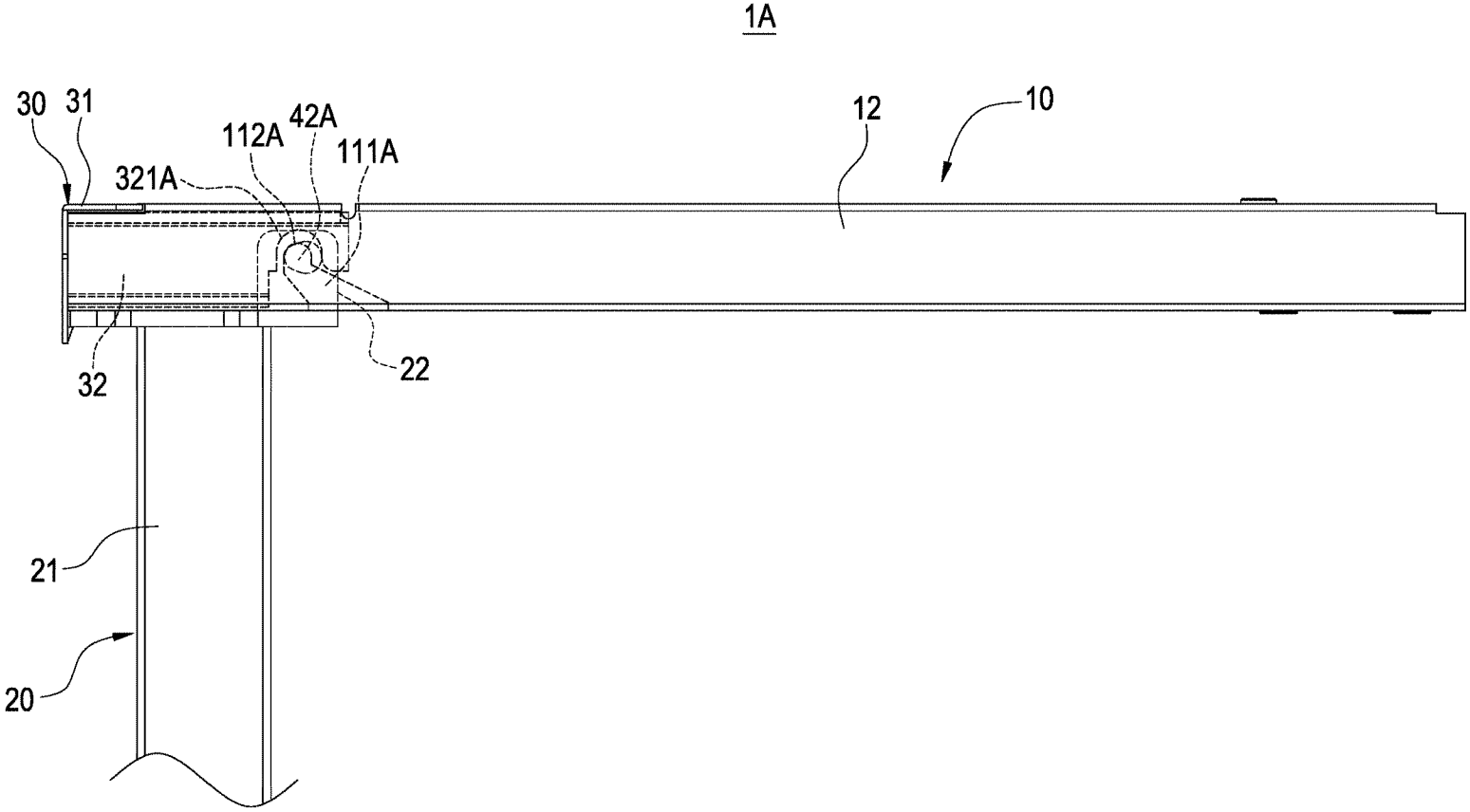
Figure 18:
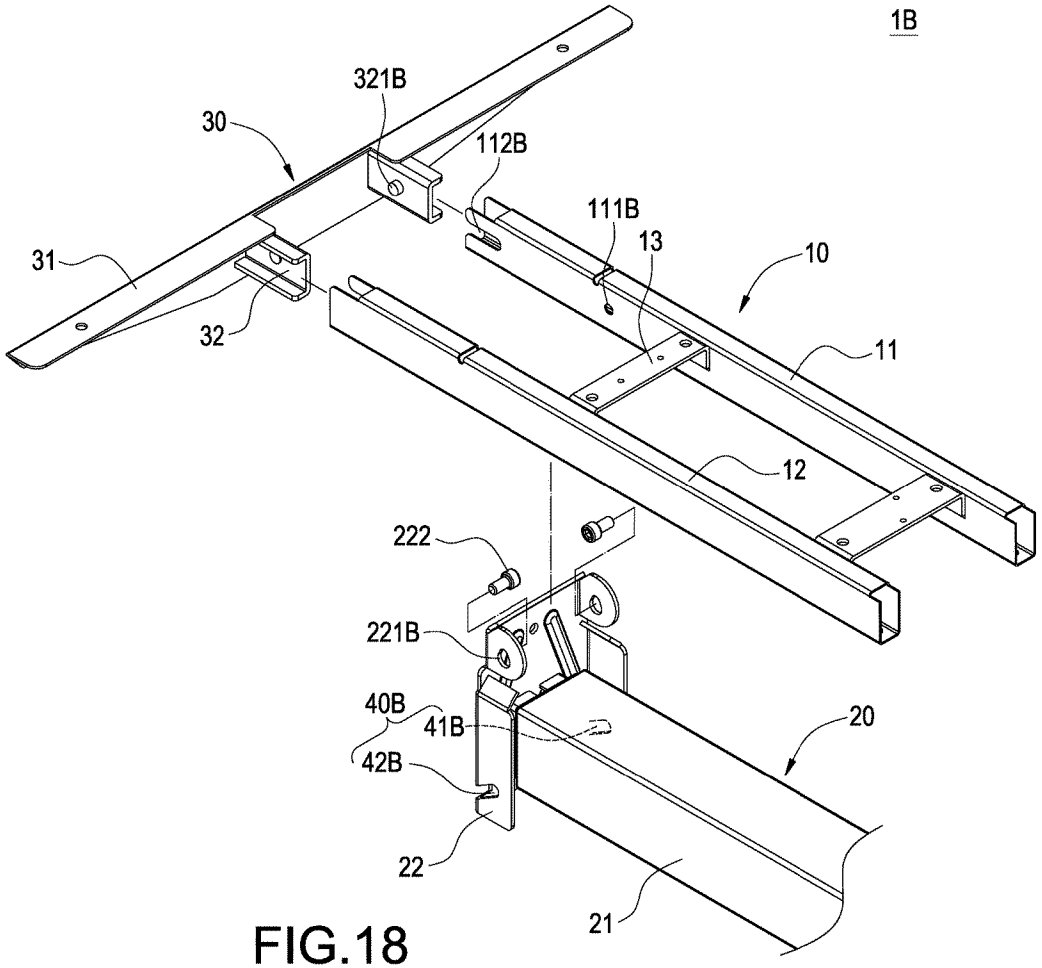
FIGS. 18-24 are exploded views, assembled views and using status views of the third embodiment of the invention.
Figure 19:
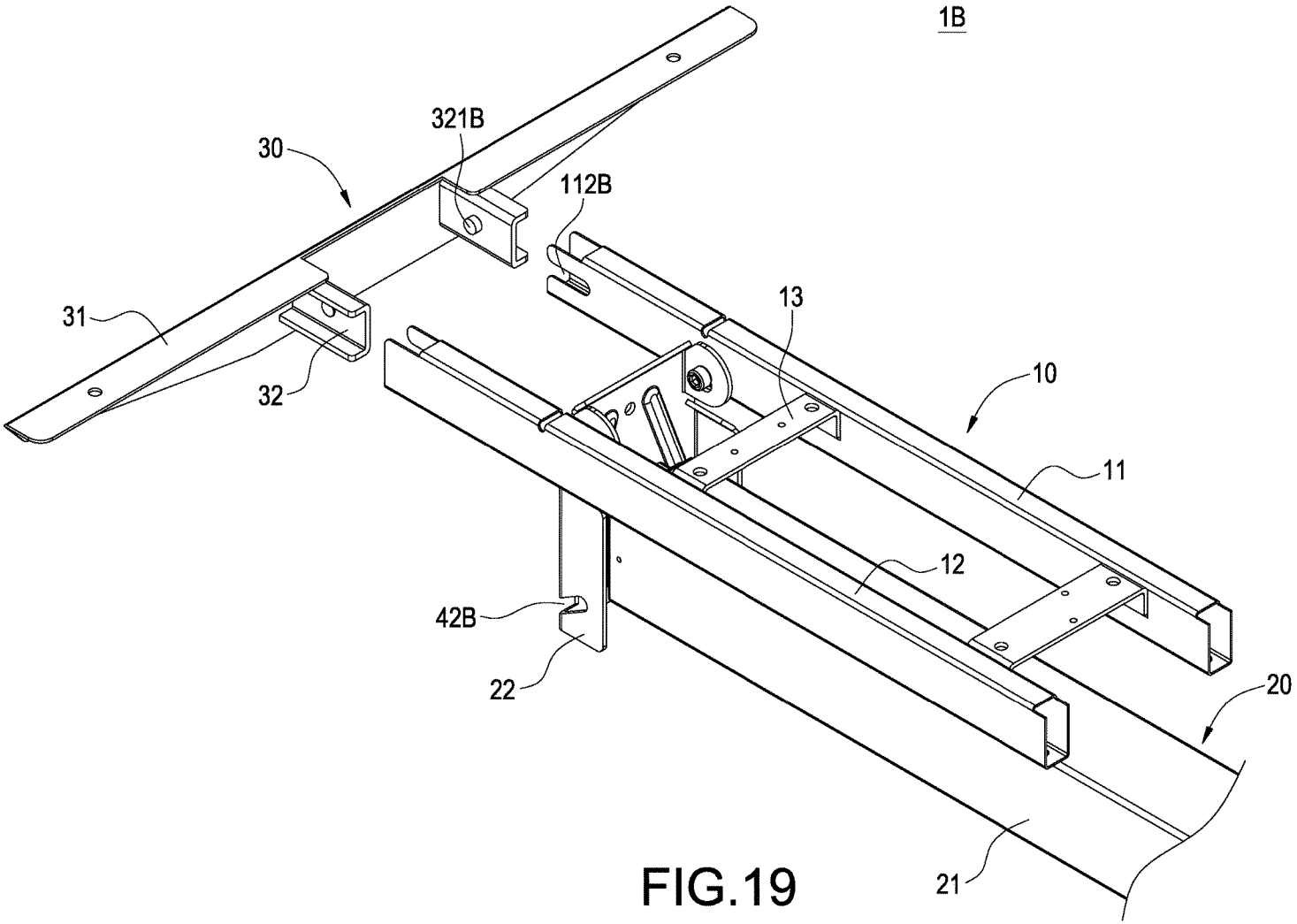
Figure 20:
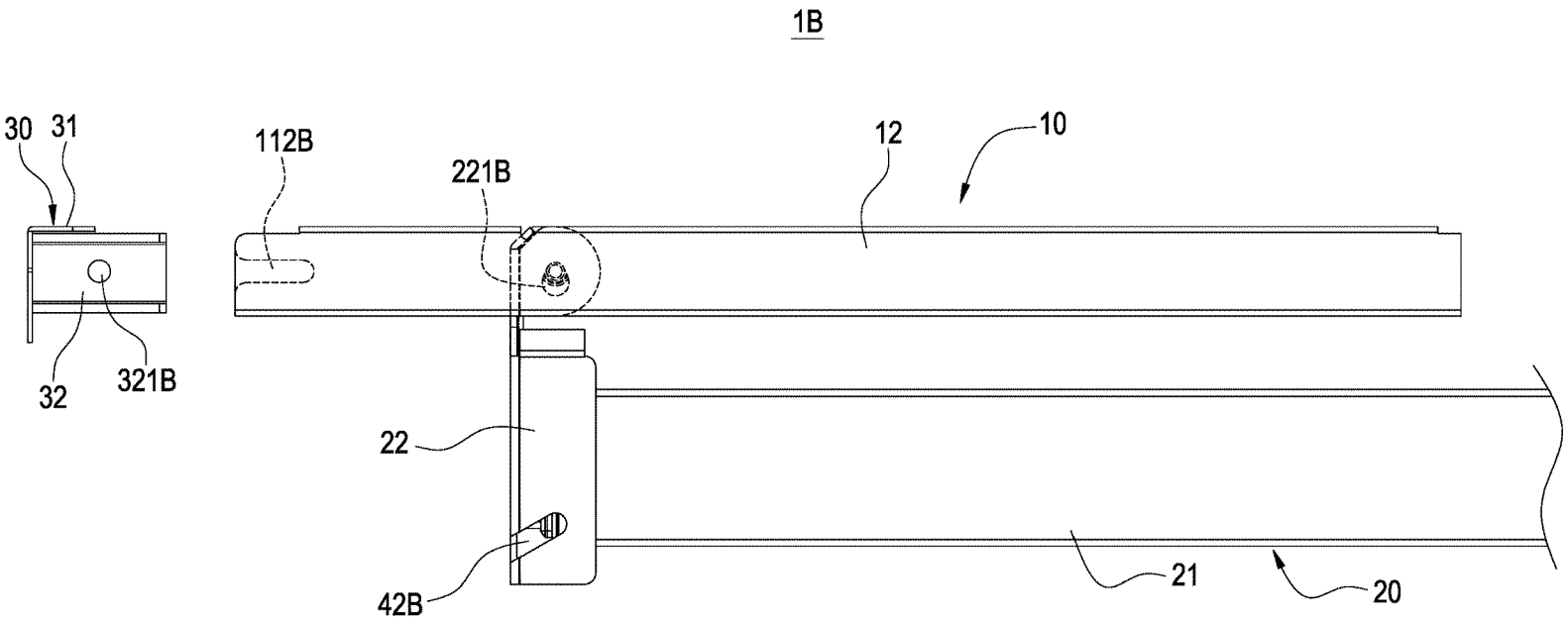
Figure 21:
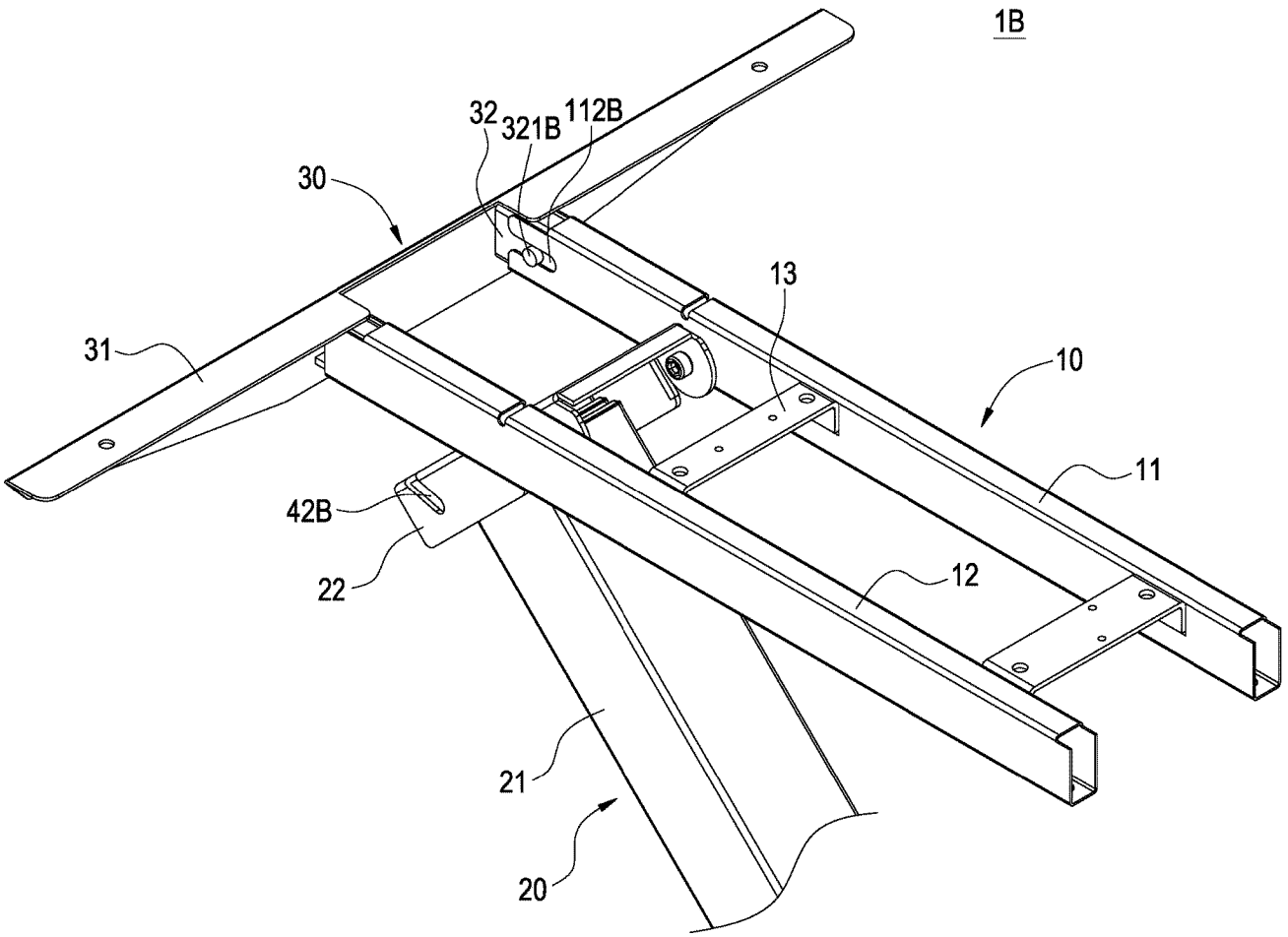
Figure 22:
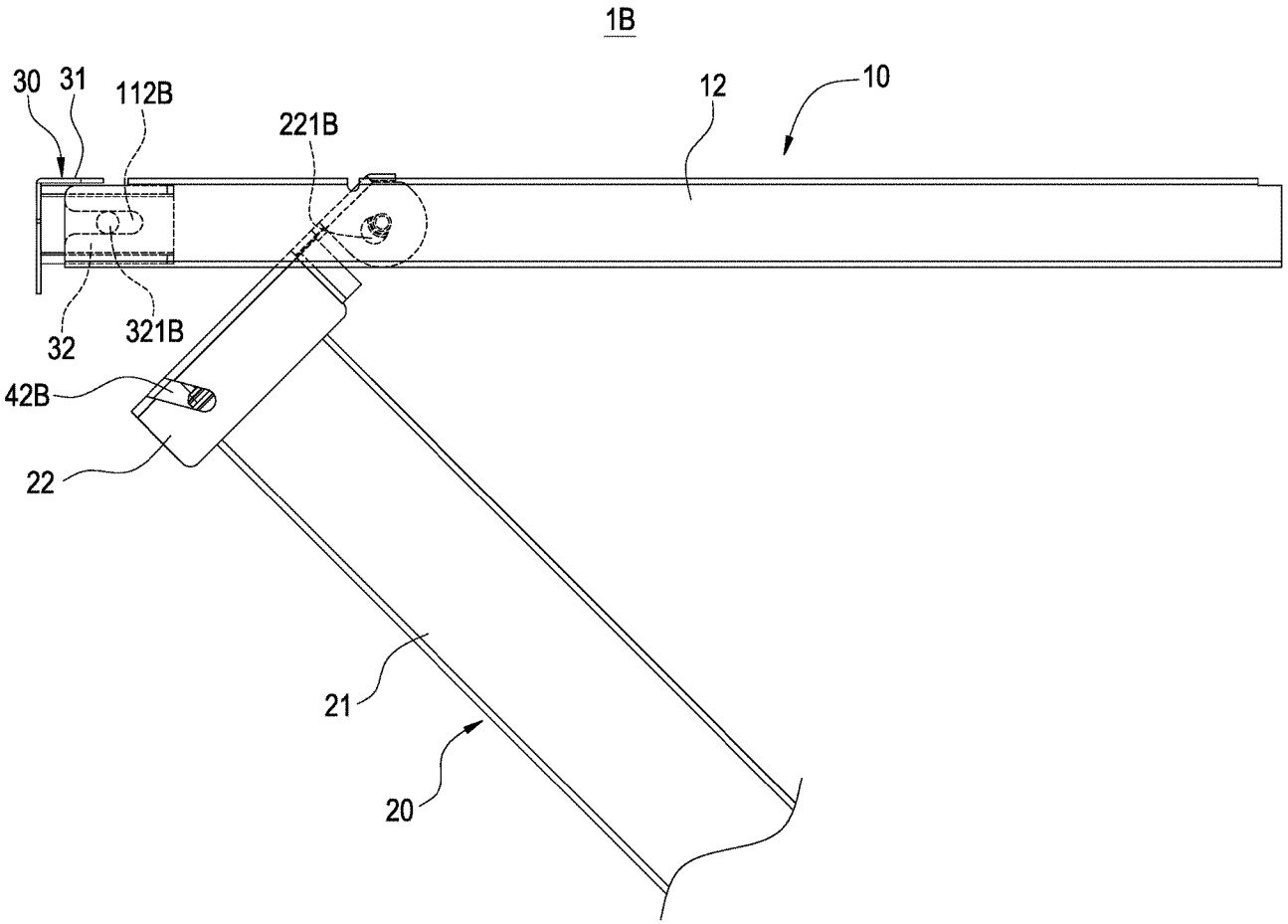
Figure 23:
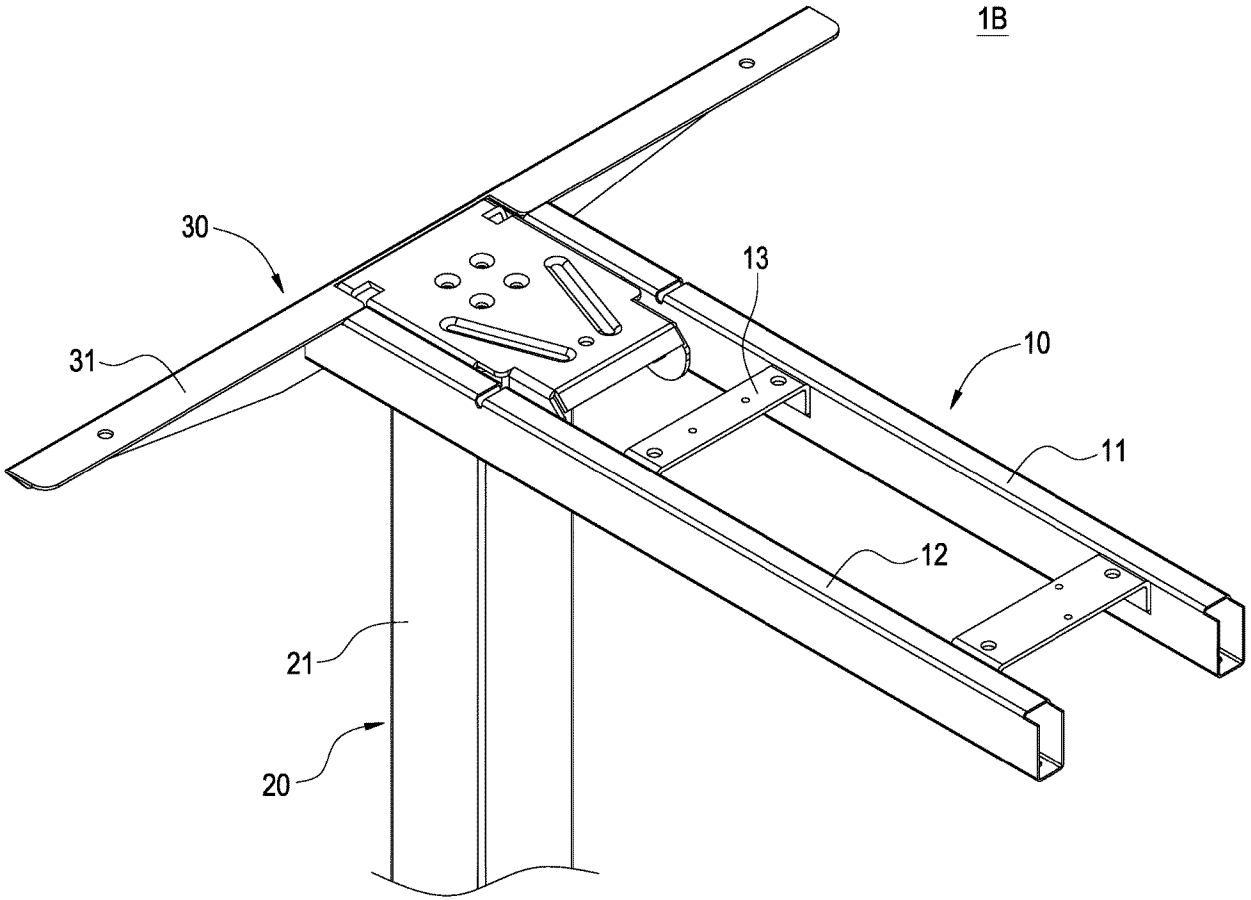
Figure 24:
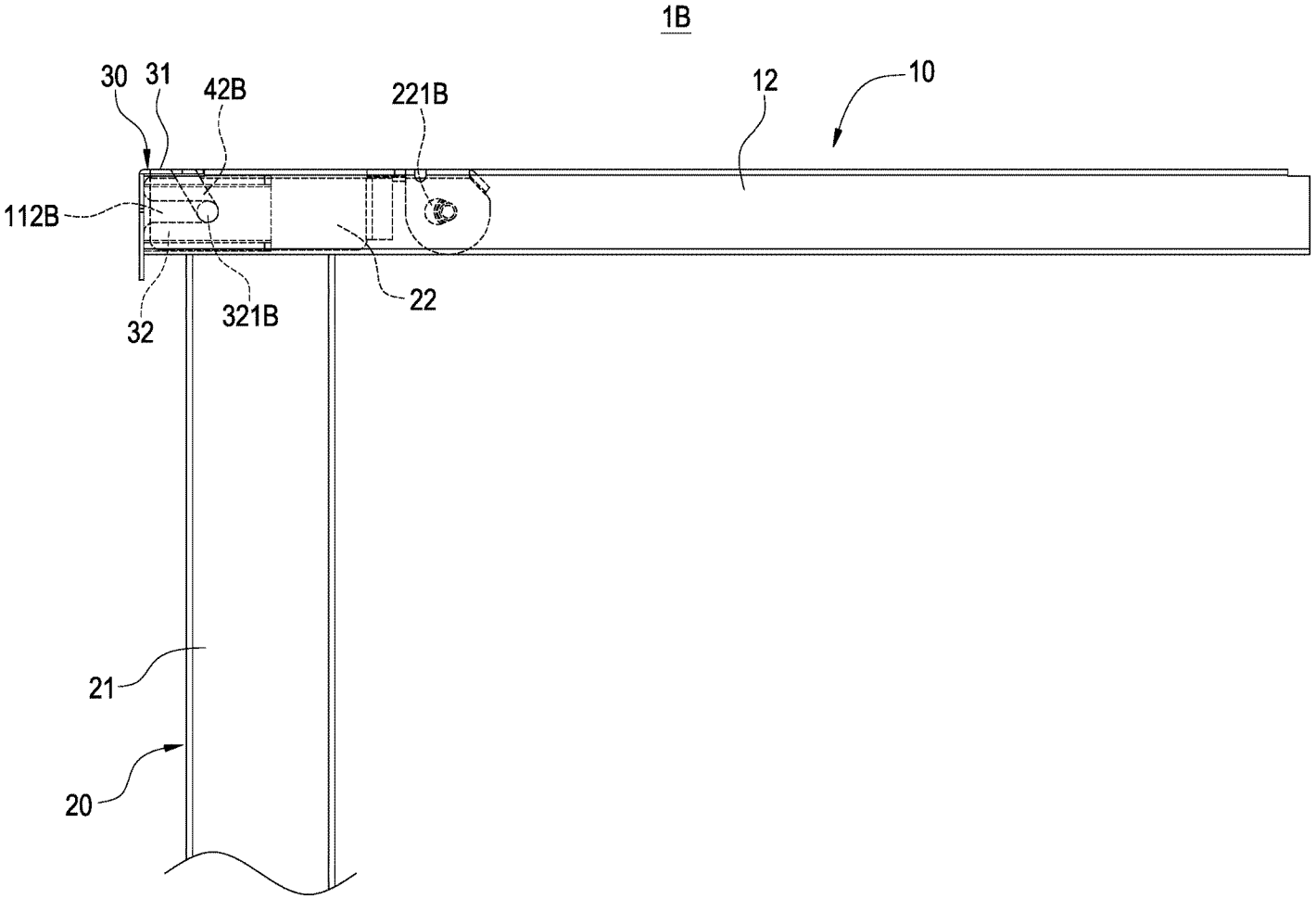

The invention provides a liftable table foot frame 1 that is easily assembled as shown in FIGS. 1-4, which includes a horizontal frame body 10, a post 20, a side wing 30 and a linking mechanism 40.

The horizontal frame body 10 includes a first horizontal rod 11, a second horizontal rod 12 and a plurality of short rods 13. The first horizontal rod 11 and the second horizontal rod 12 are parallelly arranged at an interval and are combined into the horizontal frame body 10 by being connected by the short rods 13. The first horizontal rod 11 is formed with an arced trough 111 and a rectangular hole 112. A guiding trough 113 is formed outside the rectangular hole 112 of the first horizontal rod 11. Identically, a side of the second horizontal rod 12, which corresponds to the first horizontal rod 11, is formed with an arced trough, a rectangular hole and a guiding trough (not shown) as those of the first horizontal rod 11.

An end of the post 20 is pivotally connected to the horizontal frame body 10. The post 20 includes a telescopic rod 21 and a base plate 22 connected to an end of the telescopic rod 21. The base plate 22 in this embodiment is approximately of, but not limited to, a U-shape. A threaded hole 221 is provided at each of two opposite sides of the base plate 22. Each of outsides of two opposite sides of the base plate 22 is connected with a bolt 222. The post 20 is embedded into the arced trough 111 through the bolts 222 so that the post 20 can rotate relative to the first horizontal rod 11 and the second horizontal rod 12.

The side wing 30 includes a plate body 31 and two inserting blocks 32 connected at a middle of the plate body 31. The plate body 31 in this embodiment is a longitudinal right-angled plate. A rod body 33 is connected between the two inserting blocks 32.

The linking mechanism 40 in this embodiment includes a first connecting member 41 and a second connecting member 42. A top end and a bottom end of the first connecting member 41 are formed with a through hole 415 and a hook 416, respectively. The first connecting member 41 is fastened to the base plate 22 by inserting a screw into the through hole 415 and screwing on to the threaded hole 221. The first connecting member 41 is hooked on the rod body 33 through the hook 416.

In detail, the first connecting member 41 has a buffer portion for reducing stress deformation resulting from assembling. The buffer portion includes at least one bending section. The buffer portion in this embodiment includes a first bending section 411, a second bending section 412 bendingly extending from the first bending section 411, a third bending section 413 bendingly extending from the second bending section 412 and a fourth bending section 414 bendingly extending from the third bending section 413. The through hole 415 is located in the first bending section 411 and the hook 416 is located at the fourth bending section 414. The second bending section 412 is approximately of a U-shape. Identically, the second connecting member 42 has all features the same as those of the first connecting member 41.

When assembling, the through holes 415 of the first connecting member 41 and the second connecting member 42 are passed through by a screw to be fastened to the threaded holes 221 of the base plate 22. Also, the first connecting member 41 and the second connecting member 42 are embedded into the arced trough 111 through the bolts 222 so that the linking mechanism 40, the post 20, and the horizontal frame body 10 are combined together. Next, the bending sections 414 of the first connecting member 41 and the second connecting member 42 enter insides of the first horizontal rod 11 and second horizontal rod 12 through the rectangular hole 112 so that the hooks 416 are formed inside the first horizontal rod 11 and second horizontal rod 12.

After that, the hooks 416 of the first connecting member 41 and the second connecting member 42 are hooked on the rod body 33. When the inserting blocks 32 of the side wing 30 are separately inserted into ends of the first horizontal rod 11 and second horizontal rod 12, the rod body 33 is embedded into the first horizontal rod 11 and second horizontal rod 12 along the guiding trough 113 to position the side wing 30, the horizontal frame body 10 and the linking mechanism 40.

Please refer to FIGS. 5-10. When operating, the post 20 is rotated about the bolt 222 and downward turned out relative to the first horizontal rod 11 and second horizontal rod 12 away from the horizontal frame body 10. At this time, the first connecting member 41 and the second connecting member 42 pull the inserting blocks 32 of the side wing 30 through the hooks 416 toward the first horizontal rod 11 and second horizontal rod 12 to abut, so that the horizontal frame body 10, the post 20 and the side wing 30 can be rapidly positioned. Because the buffer portion can be flexibly deformed, the first connecting member 41 and the second connecting member 42 can be firmly fixed on each side of the base plate 22.

Please refer to FIGS. 11-17. The liftable table foot frame that is easily assembled of the invention can also be implemented as this embodiment shown in the figures. The liftable table foot frame 1A includes a horizontal frame body 10, a post 20, a side wing 30 and a linking mechanism 40A.

The horizontal frame body 10 includes a first horizontal rod 11, a second horizontal rod 12 and a plurality of short rods 13. The first horizontal rod 11 and the second horizontal rod 12 are parallelly arranged at an interval and are combined into the horizontal frame body 10 by being connected by the short rods 13. The first horizontal rod 11 is formed with an inclined trough 111A and a pivot hole 112A formed at an end of the inclined trough 111A. Identically, a side of the second horizontal rod 12, which corresponds to the first horizontal rod 11, is formed with an inclined trough and a pivot hole (not shown) as those of the first horizontal rod 11.

An end of the post 20 in this embodiment is pivotally connected to the first horizontal rod 11 and second horizontal rod 12. The post 20 includes a telescopic rod 21 and a base plate 22 connected to an end of the telescopic rod 21. The post 20 in this embodiment is pivotally connected to the first horizontal rod 11 and second horizontal rod 12 through the linking mechanism 40A fixed on the base plate 22.

The side wing 30 includes a plate body 31 and two inserting blocks 32. An engaging trough 321A is formed in each of the inserting blocks 32.

The linking mechanism 40A in this embodiment includes a first cam 41A and a second cam 42A. The first cam 41A and the second cam 42A are approximately of a water drop shape and separately connected to outsides of two opposite sides of the base plate 22. The first cam 41A and the second cam 42A both pivotally connect to the first horizontal rod 11 and second horizontal rod 12 and connect to the inserting blocks 32 of the side wing 30.

When assembling, each of the inserting blocks 32 is inserted into ends of the first horizontal rod 11 and second horizontal rod 12 and each of the engaging troughs 321A is aligned with one of the pivot holes 112A. Next, the first cam 41A and the second cam 42A are separately inserted into the inclined troughs 111A and positioned in the pivot holes 112A.

When operating, the post 20 is rotated about the first cam 41A and the second cam 42A and downward turned out relative to the first horizontal rod 11 and second horizontal rod 12 away from the horizontal frame body 10. At this time, the first cam 41A and the second cam 42A are separately engaged in each of the pivot holes 112A and engaging troughs 321A. Because of the water drop shape of the first cam 41A and the second cam 42A, the inserting blocks 32 of the side wing 30 are pulled toward the first horizontal rod 11 and second horizontal rod 12 to abut, so that the horizontal frame body 10, the post 20 and the side wing 30 can be rapidly positioned.

Please refer to FIGS. 18-24. The liftable table foot frame 1B of the embodiment includes a horizontal frame body 10, a post 20, a side wing 30 and a linking mechanism 40B.

The horizontal frame body 10 includes a first horizontal rod 11, a second horizontal rod 12 and a plurality of short rods 13. The first horizontal rod 11 and the second horizontal rod 12 are parallelly arranged at an interval and are combined into the horizontal frame body 10 by being connected by the short rods 13. The first horizontal rod 11 is formed with a threaded hole 111B and a guide trough 112B. Identically, a side of the second horizontal rod 12, which corresponds to the first horizontal rod 11, is formed with a threaded hole and a guide trough (not shown) as those of the first horizontal rod 11.

An end of the post 20 is pivotally connected to the first horizontal rod 11 and second horizontal rod 12. The post 20 includes a telescopic rod 21 and a base plate 22 connected to an end of the telescopic rod 21. Each of two sides of the base plate 22 is formed with a passing hole 221B corresponding to each other. The base plate 11 is pivotally connected to the first horizontal rod 11 and second horizontal rod 12 through bolts 222 separately passing the passing holes 221B.

The side wing 30 includes a plate body 31 and two inserting blocks 32. A bar 321B is formed on each of the inserting blocks 32.

The linking mechanism 40B in this embodiment includes a first track trough 41B and a second track trough 42B. The first track trough 41B and a second track trough 42B are formed at two sides of the base plate 22, which are away from the passing holes 221B.

When assembling, each of the passing holes 221B is inserted into by a bolt 222 to fasten the base plate 22 to the threaded holes 111B. Next, the inserting blocks 21 are separately inserted into ends of the first horizontal rod 11 and the second horizontal rod 12. And the bars 321B are separately embedded into the guide troughs 112B.

When operating, the post 20 is rotated about the screws and downward turned out relative to the first horizontal rod 11 and second horizontal rod 12 away from the horizontal frame body 10. Next, the first track trough 41B and the second track trough 42B are separately engaged with each of the bars 321B. The inserting blocks 32 of the side wing 30 are pulled toward the first horizontal rod 11 and second horizontal rod 12 to abut, so that the horizontal frame body 10, the post 20 and the side wing 30 can be rapidly positioned.

Figure 25:
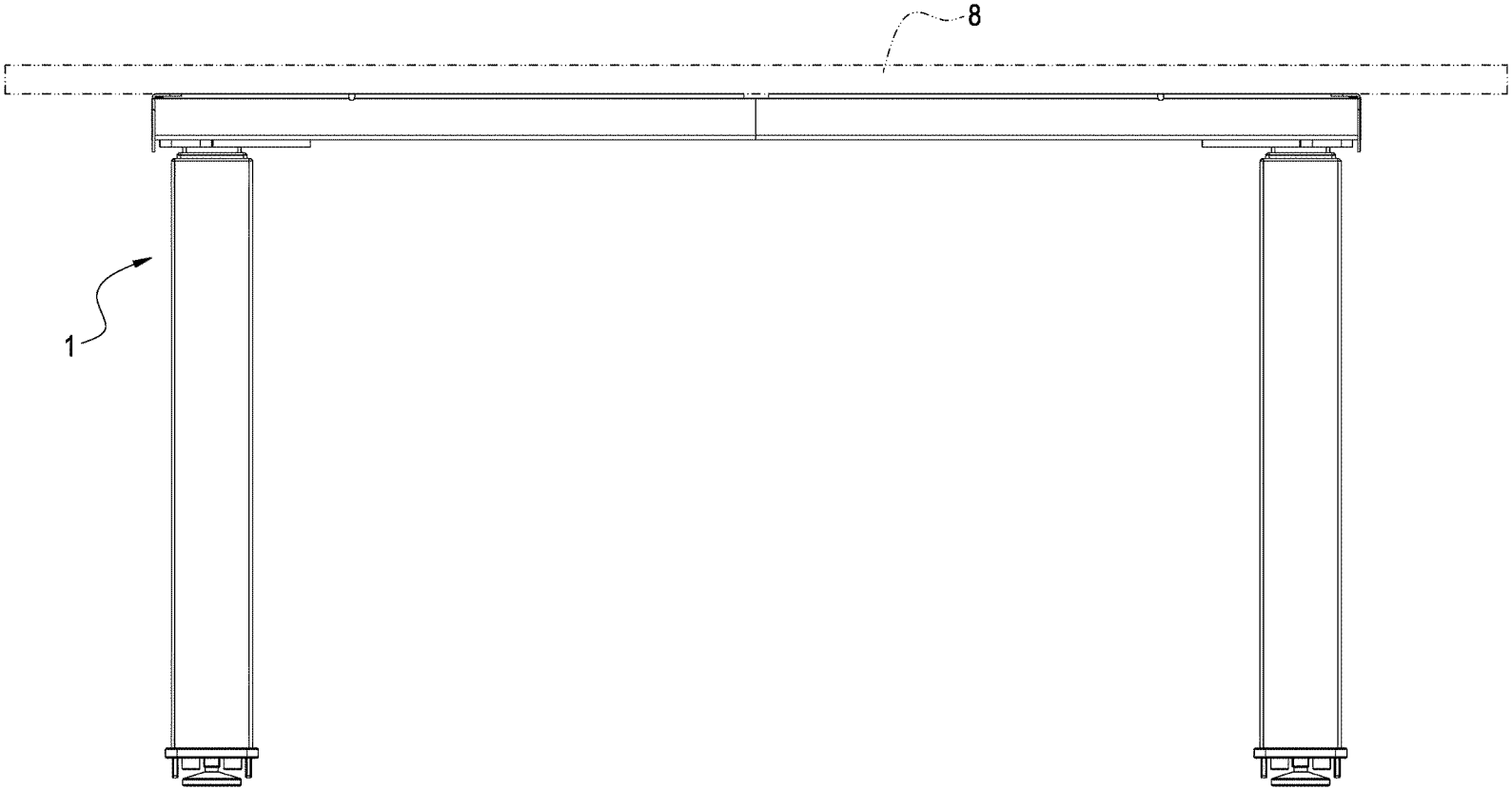
FIG. 25 is a schematic view of the invention applied to a liftable table.

Please refer to FIG. 25. The liftable table foot frame that is easily assembled of the invention may be coupled under a table board 8 to form an electrically liftable table.

It will be appreciated by persons skilled in the art that the above embodiments have been described by way of example only and not in any limitative sense, and that various alterations and modifications are possible without departure from the scope of the disclosed example as defined by the appended claims.

What is claimed is:

1. A liftable table foot frame (1) comprising:

a horizontal frame body (10) comprising two horizontal rods (11, 12), wherein each of the two horizontal rods (11, 12) is formed with an arced trough (111);

a post (20), comprising a telescopic rod (21) and a base plate (22) connected to one end of the telescopic rod (21), wherein the base plate (22) is connected with a bolt (222), the post (20) is embedded into the arced trough (111) through the bolt (222) so that the post (20) rotates relative to the two horizontal rods (11, 12) as the base plate (22) pivotally connects to each of the two horizontal rods (11, 12);

a side wing (30), comprising a plate body (31) and two inserting blocks (32) connected to the plate body (31), each of the two inserting blocks (32) coupling with an end of each of the two horizontal rods (11, 12); and a linking mechanism (40) connecting the post (20) and the side wing (30);

wherein when the post (20) is turned out relative to the two horizontal rods (11, 12), each of the inserting blocks (32) is driven toward each of the two horizontal rods (11, 12) through the linking mechanism (40) to tense and position the horizontal frame body (10), the post (20) and the side wing (30) together.

2. The liftable table foot frame (1) of claim 1, wherein rod body (33) is connected between the two inserting blocks (32), the linking mechanism (40) comprises connecting members (41, 42), and two ends of each of the connecting members (41, 42) are separately connected to the base plate (22) and the rod body (33).

3. The liftable table foot frame (1) of claim 2, wherein a top end and a bottom end of each of the connecting members (41, 42) are formed with a through hole (415) and a hook (416), respectively, and the connecting member (41) is fastened to the base plate (22) by inserting a screw into the through hole (415) and is hooked on the rod body (33) through the hook (416).

4. The liftable table foot frame (1) of claim 3, wherein each of the connecting members (41) has a buffer portion, and the buffer portion comprises at least one bending section (411).

5. The liftable table foot frame (1) of claim 2, wherein each of the horizontal rods (11) is formed with a rectangular hole (112), and the connecting member (41) enters an inside of the horizontal rod (11, 12) through the rectangular hole (112).

6. The liftable table foot frame (1) of claim 2, wherein a guiding trough (113) is formed in each of the horizontal rods (11), and the rod body (33) is embedded into each of the horizontal rods (11, 12) along the guiding trough (113).

7. A liftable table foot frame (1A) comprising:

a horizontal frame body (10) including a plurality of horizontal rods (11, 12);

a post (20), one end thereof pivotally connecting to each of the horizontal rods (11, 12);

a side wing (30), comprising a plate body (31) and a plurality of inserting blocks (32) connected to the plate body (31), each of the inserting blocks (32) separately coupling with an end of each of the horizontal rods (11, 12); and a linking mechanism (40A) connecting the post (20) and the side wing (30), wherein the post (20) comprises a telescopic rod (21) and a base plate (22) connected to the telescopic rod (21), the linking mechanism (40A) comprises cams (41A, 42A), each of the cams (41A, 42A) is separately connected to the base plate (22), the post (20) is pivotally connected to the horizontal rods (11, 12) through the cams (41A, 42A), and the cams (41A, 42A) are pivotally connected to the inserting blocks (32);

wherein when the post (20) is turned out relative to the horizontal rods (11, 12) each of the inserting blocks (32) is driven toward each of the horizontal rods (11, 12) through the linking mechanism (40) to tense and position the horizontal frame body (10), the post (20) and the side wing (30) together.

8. The liftable table foot frame (1A) of claim 7, wherein each of the horizontal rods (11) is formed with an inclined trough (111A) and a pivot hole (112A) formed at an end of the inclined trough (111A), and the cams (41A, 42A) are separately inserted into the inclined troughs (111A) and positioned in the pivot holes (112A).

9. The liftable table foot frame (1A) of claim 8, wherein an engaging trough (321A) is formed in each of the inserting blocks (32), each of the engaging troughs (321A) is arranged to correspond to each of the pivot holes (112A), and the cams (41A, 42A) are separately positioned in each of the engaging troughs (321A).

10. The liftable table foot frame (1A) of claim 7, wherein each of the cams (41A, 42A) is of a water drop shape.

11. A liftable table foot frame (1B) comprising:

a horizontal frame body (10) including a plurality of horizontal rods (11, 12);

a post (20), one end thereof pivotally connecting to each of the horizontal rods (11, 12);

a side wing (30), comprising a plate body (31) and a plurality of inserting blocks (32) connected to the plate body (31), each of the inserting blocks (32) separately coupling with an end of each of the horizontal rods (11, 12); and a linking mechanism (40B) connecting the post (20) and the side wing (30), wherein the post (20) comprises a telescopic rod (21) and a base plate (22) connected to the telescopic rod (21), the base plate (22) is pivotally connected to the horizontal rods (11, 12), the linking mechanism (40B) comprises track troughs (41B, 42B), the track troughs (41B, 42B) are formed in the base plate (22), a bar (321B) is formed on each of the inserting blocks (32), and the track troughs (41B, 42B) are separately engaged with each of the bars (321B);

wherein when the post (20) is turned out relative to the horizontal rods (11, 12) each of the inserting blocks (32) is driven toward each of the horizontal rods (11, 12) through the linking mechanism (40B) to tense and position the horizontal frame body (10), the post (20) and the side wing (30) together.

12. The liftable table foot frame (1B) of claim 11, wherein each of the horizontal rods (11) is formed with a guide trough (112B), and the bars (321B) are separately embedded into the guide troughs (112B).

* * * * *